US012427382B2

(12) United States Patent
Eshleman et al.

(10) Patent No.: US 12,427,382 B2
(45) Date of Patent: Sep. 30, 2025

(54) METHODS AND APPARATUS FOR AIDING GOLFER GAMEPLAY

(71) Applicant: We Goin Forward, LLC, Longmont, CO (US)

(72) Inventors: Joseph W Eshleman, Longmont, CO (US); John L Eshleman, Lincoln, NE (US)

(73) Assignee: ClubOven LLC, Mead, CO (US)

( * ) Notice: Subject to any disclaimer, the term of this patent is extended or adjusted under 35 U.S.C. 154(b) by 0 days.

(21) Appl. No.: 18/881,404

(22) PCT Filed: Jan. 14, 2022

(86) PCT No.: PCT/US2022/012558
§ 371 (c)(1),
(2) Date: Jan. 6, 2025

(87) PCT Pub. No.: WO2022/155492
PCT Pub. Date: Jul. 21, 2022

(65) Prior Publication Data

US 2025/0256164 A1 Aug. 14, 2025

Related U.S. Application Data

(60) Provisional application No. 63/137,439, filed on Jan. 14, 2021.

(51) Int. Cl.
*A63B 55/00* (2015.01)
*A63B 47/00* (2006.01)

(52) U.S. Cl.
CPC ..... *A63B 47/005* (2013.01); *A63B 55/404* (2015.10); *A63B 2225/64* (2013.01)

(58) Field of Classification Search
CPC .. A63B 47/005; A63B 55/404; A63B 2225/64
USPC ..... 206/315.3; 150/159
See application file for complete search history.

(56) References Cited

U.S. PATENT DOCUMENTS

| | | | | |
|---|---|---|---|---|
| 3,707,279 A | | 12/1972 | Kaiser | |
| 3,800,863 A | | 4/1974 | Bauman | |
| 4,796,789 A | * | 1/1989 | Willcocks | A63B 55/00 206/315.6 |
| 5,915,373 A | * | 6/1999 | Malover | A63B 55/20 126/263.01 |
| 6,263,591 B1 | * | 7/2001 | La Porte | F26B 9/003 34/106 |
| 6,273,158 B1 | | 8/2001 | Sharpe | |

(Continued)

*Primary Examiner* — Don M Anderson
*Assistant Examiner* — Jessica Kavini Tamil

(57) ABSTRACT

Methods and apparatus for aiding golfer gameplay are disclosed. Embodiments may involve a heated cover (2) for a golf bag (201). Golf club heads (202) may be received within an inner warmth area or areas (24) of the cover (2), and golf balls (224) may be received within an inner warmth area or areas (24) of one or more pouches (6) (20). Processed golf round data (216) may be utilized by a golf gameplay aid (223), which in some embodiments may be one or more thermostats (214). Thermostats (214) may raise, lower, or otherwise regulate the temperature in one or more inner warmth areas (24) by controlling one or more heat sources (204). Golf equipment may be heated to achieve specific, desirable performance characteristics to aid golfer gameplay.

32 Claims, 9 Drawing Sheets

(56) References Cited

U.S. PATENT DOCUMENTS

| | | | | |
|---|---|---|---|---|
| 8,215,465 | B2 * | 7/2012 | Iceberg | A45C 3/001 190/125 |
| 2007/0082756 | A1 | 4/2007 | Lee | |
| 2007/0251844 | A1 | 11/2007 | Reid | |
| 2009/0321290 | A1 | 12/2009 | Kuo | |
| 2016/0303443 | A1 * | 10/2016 | Boggs | A63B 53/14 |

* cited by examiner

METHODS AND APPARATUS FOR AIDING GOLFER GAMEPLAY

This application is a PCT patent application claiming priority to and the benefit of U.S. Provisional Application No. 63/137,439, filed Jan. 14, 2021, such patent application and any priority case hereby incorporated herein by reference in its entirety.

TECHNICAL FIELD

Generally, this invention is related to improving the performance of golf balls and golf equipment in colder conditions. In colder temperatures, golf equipment and materials may become less elastic and more brittle, which may cause a decrease in performance of golf equipment. By adding an insulated, heated hood/cover, with separate heating compartments for golf balls, plus a seal at the bottom of the hood, creating a warm pocket of air inside a golf bag, an increased performance of golf equipment and golf balls may be achieved. The invention may have particular applicability to coordinating the heating of golf equipment to affect or even achieve specific, desirable performance characteristics for such golf equipment.

BACKGROUND

In today's growing market for golf and sporting equipment, consumers are becoming more and more competitive. Consumers may be looking for ways to improve the performance of their game and equipment. In the golf industry, customers, club manufacturers, and golf ball manufacturers may be aware that golf club and ball performance can be degraded by cold conditions, possibly beginning at temperatures lower than approximately 80 degrees Fahrenheit (F). Golf ball and golf club performance may be significantly degraded at temperatures in the range of 40 to 80 degrees F. Golf balls may lose elasticity as temperatures drop, thus possibly resulting in less compression of the golf ball, which may mean that less energy is transferred from the club swing to the ball. This may result in the ball physically not being able to travel further. Therefore, any golfer playing at temperatures below said threshold may experience a loss of distance when the ball is struck. Furthermore, the ball may incur reduced spin characteristics at lower temperatures, thus possibly decreasing accuracy. In addition, golf club performance may be adversely impacted at reduced temperatures. As but a few non-limiting examples, a grip of a golf club may become harder to grasp, the shaft may become less flexible, the clubface may lose the "spring" effect, and some clubfaces can actually break when striking golf balls at colder temperatures. A vital part of improved golf ball and club performance may be to minimize contact with cooler air and moisture when the club and ball are not in play. Keeping cold air out may not be sufficient by itself to generate an adequate temperature change for a golfer to experience improved golf ball and golf equipment performance. A weatherproof, scalable bag cover may include a primary or main heating source applied to the inside of the cover, creating a pocket of warm air inside the top of the golf bag and especially close to the golf club heads. The warm air inside the bag may improve the "reflex" effect of the clubface of the golf club, may improve the flex performance of both steel and graphite golf shafts, and may allow the golf club to be gripped easier, possibly with a warmed grip surface. However, as there may be two components that enable a golfer to play, the club and the ball, it may be essential to keep the ball at the desired temperature as well. The present invention may include separate, heated golf ball pockets to ensure optimal ball temperature.

DISCLOSURE OF THE INVENTION

In general, the present invention may involve both devices and methods in a variety of embodiments to achieve improved golf ball and golf club performance, especially when used in conjunction with conventional golf club carrying bags. Embodiments of the present invention may include several aspects that may be beneficial to the golfer.

The present invention may include a variety of aspects to help golfers improve golf ball and golf club performance in cold conditions. By combining various technologies and materials in, for example, a lightweight, portable, reusable cover, the present invention may provide golfers or other users the opportunity to improve performance and lower scoring by, for example, changing the environment, from cold to warm, in which a golfer's golf clubs and golf balls are kept while playing or otherwise. In some embodiments, the heating element may be turned on immediately when the golfer arrives at the golf course to cause an immediate beneficial impact. In other embodiments, the heating element may be powered on prior to the golfer arriving at the golf course to achieve a pre-warmed benefit upon arrival to the course. The broad objective may include obtaining improved performance from the golfer's existing equipment at minimal cost and to be available on an "as-needed" basis because the invention may be highly portable and applied quickly if weather conditions change suddenly.

For golfers to achieve improved scores and performance, it may be a priority to achieve maximum distance with each shot and for the golf ball to maintain its spin characteristics on short shots. In addition, golfers may typically strive to achieve an accurate "feel" to provide feedback after each shot. It may also be important for golfers to be able to choose the right club for the shot. The present invention may aid in helping golfers achieve improved performance with no change in equipment. It may be an objective of the invention to coordinate the heating of golf equipment to affect or even achieve a desired quality of both the foregoing factors and other factors capable of being influenced by the heating techniques discussed herein.

Naturally, other goals and objects of the present invention are disclosed throughout the text, clauses, and claims.

MODE(S) FOR CARRYING OUT THE INVENTION

It should be understood that embodiments include a variety of aspects, which may be combined in different ways. The following descriptions are provided to list elements and describe some of the embodiments of the application. These elements are listed with initial embodiments; however, it should be understood that they may be combined in any manner and in any number to create additional embodiments. The variously described examples and preferred embodiments should not be construed to limit the embodiments of the application to only the explicitly described systems, techniques, and applications. The specific embodiment or embodiments shown are examples only. The specification should be understood and is intended as supporting broad claims as well as each embodiment, and even claims where other embodiments may be excluded. Importantly, disclosure of merely exemplary embodiments is not meant to limit the breadth of other more encompassing claims that may be made where such may be only one of several methods or embodiments which could be employed in a broader claim or the like. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 1:
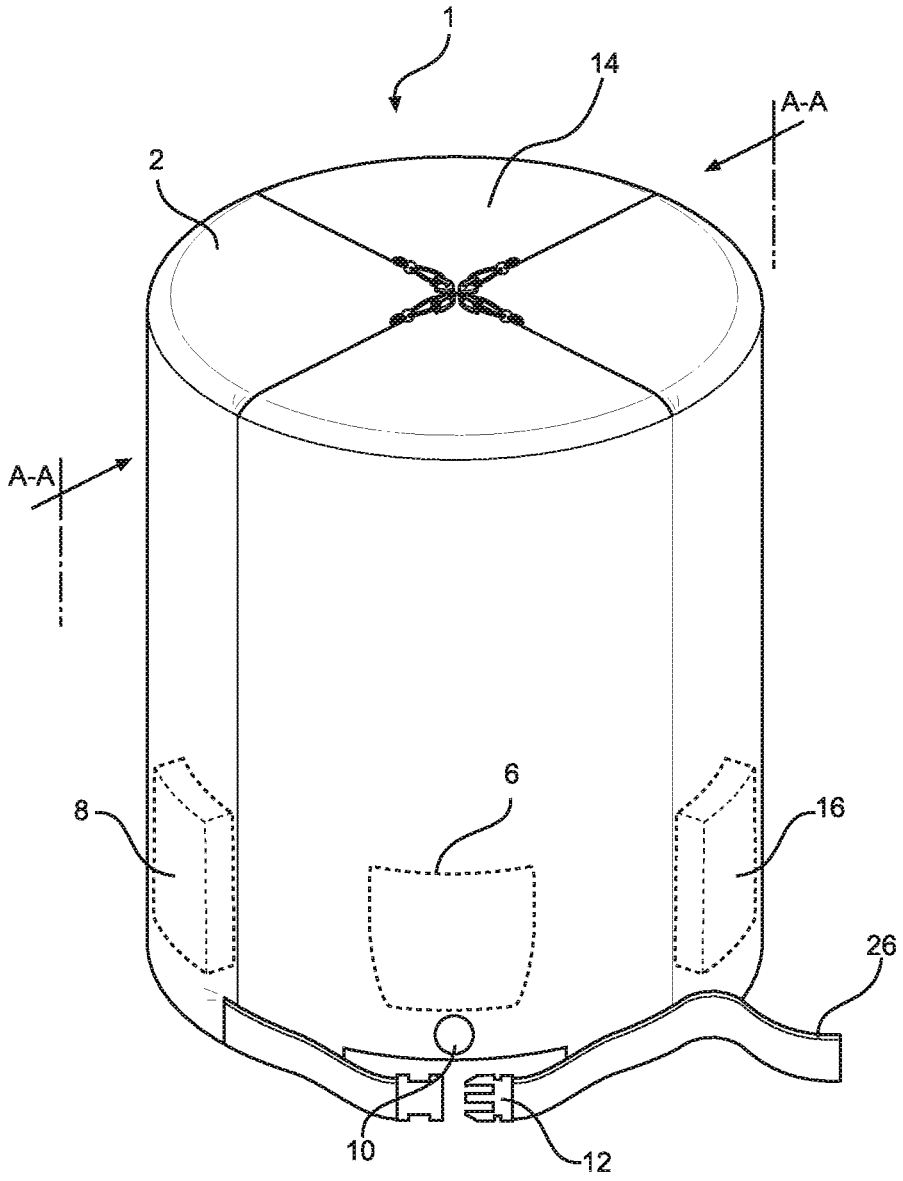
FIG. 1 is an exemplary embodiment of the present invention heating system of a golf bag cover for improved golf ball and club performance.

FIG. 1 is an exemplary embodiment of the present invention, including a heating system (1) for a golf bag cover for improved golf ball and club performance. In certain embodiments, to begin the warming process, it may be important to apply the outside cover (2), which may be made of a material that may be insulated and waterproof. In some embodiments, an outside cover (2) may allow heated air to remain inside the bag and prevent cold air and moisture from penetrating the exterior of the bag. The outside cover (2) may have an easy access rapid closure system (14). The easy access rapid closure system (14) may include, but may not be limited to, a zipper, hook and loop type closure, magnetic closure, snap closure, or similar entry mechanism, to quickly and efficiently access all golf clubs, balls, or other equipment, while wearing or not wearing gloves, and easily close the bag after a club or other desired equipment has been removed and then possibly replaced after each shot, which may reduce outside exposure minimizing contact with outside elements while handling the equipment. In another embodiment, the easy access rapid closure system (14) may include an assisted closure mechanism that may aid a user in closing the bag to ensure maximum heat retention to ensure optimal heating. This assisted closure mechanism may be, but is not limited to, a springed component, a mechanical (linkage or geared) component, or a counterweighted closure component.

FIGS. 1, 2, 3, and 5 may show a heated cover (2) for a golf bag (201) in exemplary embodiments. The cover (2) may be configured to enclose the top end of a golf bag (201) and may involve the step of enclosing the top end of a golf bag (201) with a cover. The cover (2) naturally may be of any size, shape, material, configuration, or the like sufficient to enclose the top end of the golf bag (2) that otherwise is consistent with the inventive principles discussed herein. In various embodiments, a cover (2) may be any or any combination of an insulated cover (2), a waterproof cover (2), a one removeable piece cover (2), a lightweight cover (2), a portable cover (2), a reusable cover (2), a breathable cover (2), and a quick change cover (2). As may be further described herein, some embodiments may utilize a heated golfer assist cover (2) for a golf bag and accordingly may involve a method for heating the cover of a golf bag and a method for assisting a golfer.

Figure 2:
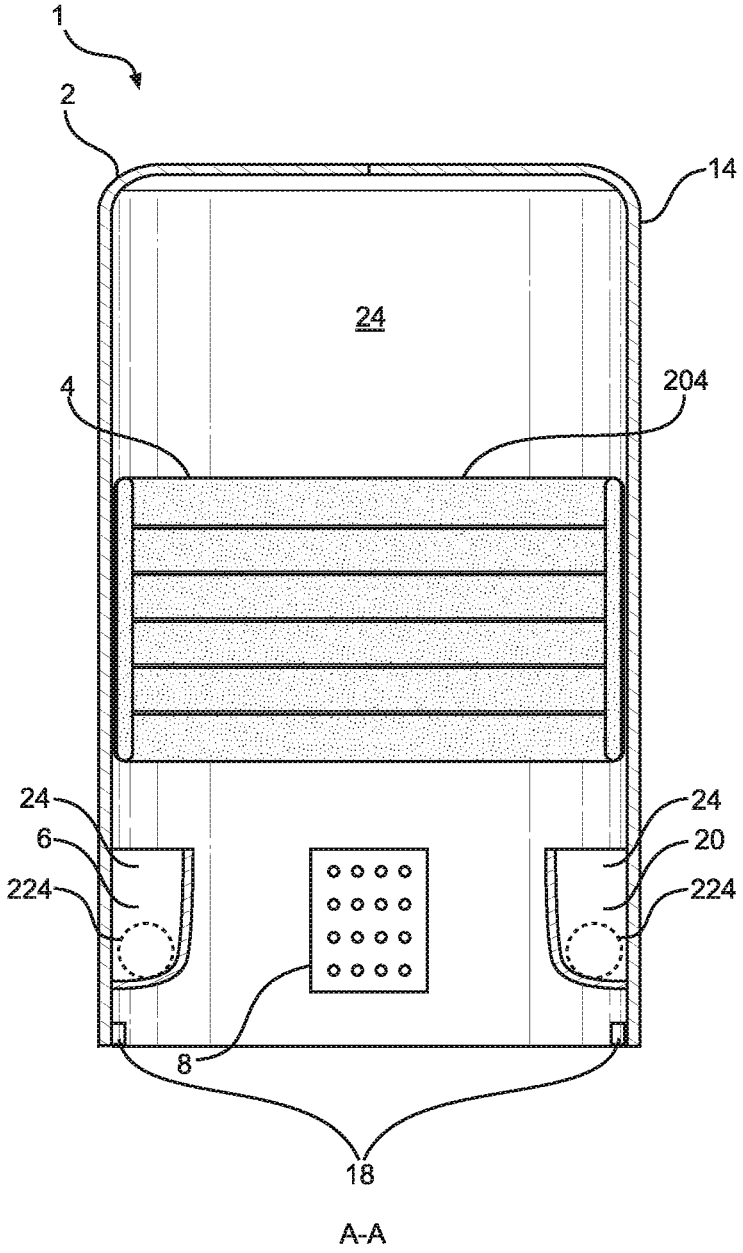
FIG. 2 is an exemplary cross-sectional illustration of one embodiment of an interior structure of a heating system of a golf bag cover for improved golf ball and club performance.

In some embodiments, the outside cover (2) may include a heated ball pouch (6). A golf ball may be exposed to cold air during play longer than other items of equipment. Therefore, having an optimally warmed ball available for each hole may be a beneficial performance enhancement. In another embodiment, it may be beneficial to provide at least two heated ball pouches. A first heated ball pouch (6) may be used as a primary heating source and then to ensure the golfer is using an optimally warmed ball, a secondary "used cold ball," a ball that was previously warmed, played with and returned to ambient temperature, heated ball pouch may be utilized. This cold ball heated pouch (20 as shown in FIG. 2) may allow golfers to rotate golf balls after each hole to possibly keep a warm ball in play at all times. Utilizing at least two heated ball pouches may keep cold golf balls separated from warm ones for accelerated warming processes, and accordingly may be considered to be one or more cold contamination prevention golf ball pouches (6) (20) and/or one or more accelerated warming golf ball pouches (6) (20), and may involve the step of preventing cold contamination of at least one golf ball pouch (6) (20) and/or the step of accelerating the warming of at least one golf ball (224). Multiple heated ball pouches would add an additional heat source to the hood providing heating support to the primary or main internal warming function. Embodiments accordingly may involve the inner warmth area (24) of one or more golf ball pouches (6) (20) as an additional heat source (204) for an inner warmth area (24) of a cover (2), and may involve the step of additionally applying heat to an inner warmth area (24) of a cover (2). These heated ball pouches may include a rapid closure system similar to the outside cover to possibly allow easy access and to be opened or closed while wearing gloves. The heated ball pouch closures may include a few non-limiting examples: a zipper, hook and loop type closure, magnetic closure, snap closure, or similar entry mechanism to quickly and efficiently access all golf balls. The heated ball pouch (6) and cold ball heated pouch (20) may be accessible from inside the outside cover (2), and other elements may be accessible from outside the outside cover. In some embodiments, the heated ball pouches may be accessible both internally and externally. Embodiments accordingly may involve at least two golf ball pouches (6) and/or (20) of a cover (2) disposed inside of the cover (2).

Golf may typically be a mobile sport, and therefore it may be desirable to have a heating element (as well as all additional components that require power) that is able to be powered remotely, in the sense that it can be powered away from a conventional home wall power outlet. Embodiments therefore may have any suitable power source otherwise consistent with the inventive principles disclosed herein for all components requiring power. As shown in FIG. 1, embodiments of the present invention may include two battery-powered energy supplies. This embodiment may include a primary power source (8) and a secondary power source (16) for backup power. These power sources may include batteries, such as but not limited to, Nickle-Cadmium, Lithium-Ion, Lithium-Ion Polymer, alkaline, or lead-acid type batteries. In some embodiments, the power source may be inserted into a pocket in the outside cover (2), which may include a connection to the heating element and charging cord that could plug into adaptable outlets, including those located on golf carts or other external sources. In some embodiments, the external source may be that of a wall outlet to charge the power source. In another embodiment, the external source may be photovoltaic cells woven into or attached to the outside cover to charge the power sources while in play. The primary power source (8) may provide the power source for all heating elements (including but not limited to the primary hood and heated ball pouches). In some embodiments, having a secondary power source (16) for backup power placed at least 180 degrees from the primary power source and charging port may be beneficial because a round of golf may typically last between three to six hours. By providing additional storage for a spare secondary power source (16), the golfer may be assured not to be without power, even possibly during extended rounds. In some embodiments, a golfer or other user may have to manually switch between a primary and secondary power source when the primary power source (8) is depleted. In another embodiment, the secondary power source (16) may be connected to the primary power source (8) and either automatically start charging the primary power source (8) when the primary is depleted or automatically start powering the system directly from the secondary power source (16) when the primary power source's energy store is depleted.

More generally, embodiments may involve at least one power source (8) of a cover (2) to which any or any combination of a heat source or heat sources (204), a circulation component or components (22), a data input or inputs (210), a data storage or storages (212), a data processor or processors (213), an automated closure system actuator or actuators (206), a thermostat or thermostats (214), a golfer advice output or outputs (215), a golf gameplay aid or aids (223), and an input module or modules (101), or the like are responsive.

Figure 9:
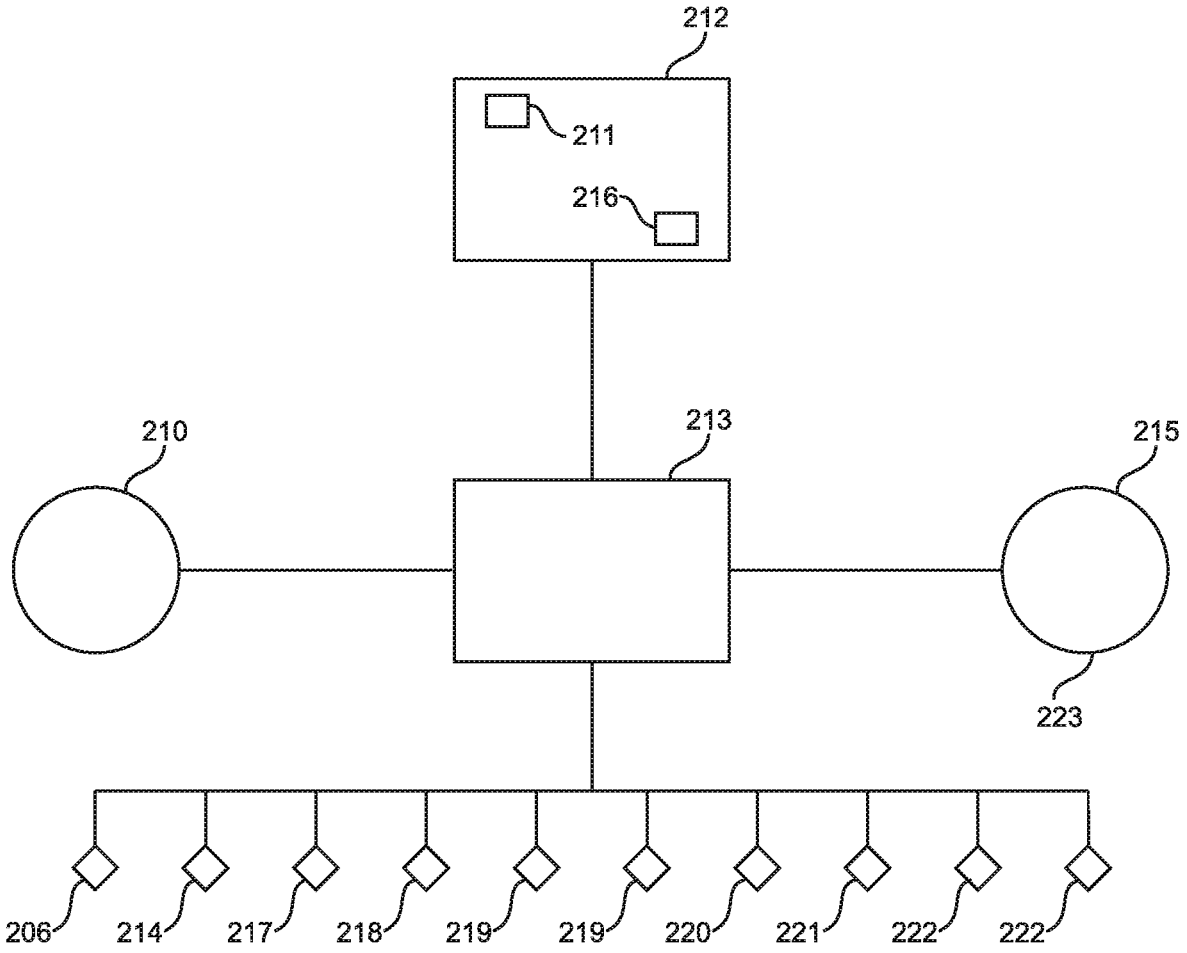
FIG. 9 is an exemplary diagram in one embodiment of a data processor layout.

As shown in FIG. 9, the cover (2) in various embodiments may utilize a data input (210). The data input (210) may include any software or hardware capable of receiving golf round data (211), and in various embodiments may include cameras, microphones, keyboards, keypads, touch pads, mouses, joysticks, track pads, track balls, motion capture devices, biometric capture devices, video cards, sound cards, network cards, modems, screens, touch screens, displays, speakers, headphones, headsets, GPS devices, smartphones, handheld devices, sensors, temperature sensors, humidity sensors, and the like. The data input (210) may be implemented in any manner otherwise consistent with the inventive principles discussed herein, and in embodiments may be part of a cover (2), part of an input module (101), may be self-contained with the cover (2), or may utilize components separate from the cover, such as a golfer's smartphone or other similar handheld device, or such as hardware or software that may be accessed via connection to a networked environment. Embodiments may involve the step of inputting golf round data (211) into a data input (210) of a cover (2).

A data input (210) in various embodiments may be either or both of a manual data input (210), which generally may involve the manual input of data such as by a golfer, or an automated data input (210), which generally may involve the input of data without such manual entry. Embodiments accordingly may involve manually inputting golf round data (211) and automatically inputting golf round data (211).

In various embodiments, a data input (210) may be responsive to at least one temperature sensor (such as may be described elsewhere herein). The input information may be a temperature or other temperature information detected by such sensors. For example, embodiments may include one or more internal temperature sensors (217), which may measure a temperature in one or more areas inside a cover (2) and/or a golf bag (201), one or more external temperature sensors (218), which may measure a temperature outside of a cover (2) or a golf bag (201), and/or one or more section-specific temperature sensors (219), which may measure a temperature in one or more sections of sectioned inner warmth areas (207) of a cover (2). Accordingly, various embodiments may involve inputting temperature data, inputting internal temperature data, inputting external temperature data, and inputting multiple section-specific temperature data.

In various embodiments, a data input (210) may be responsive to at least one humidity sensor (such as may be described elsewhere herein). The input information may be a humidity or other humidity information detected by such sensors. For example, embodiments may include one or more internal humidity sensors (217), which may measure a humidity in one or more areas inside a cover (2) and/or golf bag (201), one or more external humidity sensors (218), which may measure a humidity outside of a cover (2) or a golf bag (201), and/or one or more section-specific humidity sensors (219), which may measure a humidity in one or more sections of sectioned inner warmth areas (207) of a cover (2). Accordingly, various embodiments may involve inputting humidity data, inputting internal humidity data, inputting external humidity data, and inputting multiple section-specific humidity data.

Accordingly, embodiments may include a data input (210) of a cover (2) configured for the input of golf round data (211). Data may be generally known and understood for the technical field described herein, and may be understood to involve any and all kinds of data generally known in the art suitable for use with the inventive principles discussed herein. Golf round data (211) may be any information relevant for or pertaining to a round of golf or other golfing activity in which the cover (2) may be used. Examples of golf round data (211) may include:

- Gofer handicap data.
- Golfer biometrics data (such as height, weight, age, gender, and the like).
- Golf club head data.
- Golf club shaft data.
- Golf club grip data.
- Golf club type data.
- Golf club make data.
- Golf ball data.
- Golf ball spin data.
- Golf ball distance data.
- Golf course gameplay data (which may be aspects of a given golf course affecting golfer play thereon, such as par, yardage, hazard locations, and the like).
- Golfer preference data (which may be any data reflecting a golfing preference of a golfer, such as desired temperature ranges, desired humidity ranges, desired equipment elasticity or feels, and the like).

Embodiments accordingly may involve inputting golfer handicap data, golfer biometrics data, golf club head data, golf club shaft data, golf club grip data, golf club type data, golf club make data, golf ball data, golf ball spin data, golf ball distance data, golf course gameplay data, and golfer preference data.

In some embodiments, golf round data (211) may be real-time data, which may be data reflecting a current or near-current value of a parameter or condition that otherwise may vary over time. Examples of real-time data may include:

Real-time golf course conditions data.

Real-time ambient temperature data.

Real-time ambient humidity data.

Real-time weather data.

Real-time golf course position data.

Moreover, real-time data may be delivered in any manner suitable for and otherwise consistent with the inventive principles discussed herein, and examples of real-time data accordingly may include real-time GPS data, real-time cellular data, real-time RFID data, real-time Bluetooth data, real-time WiFi data, and the like. Embodiments accordingly may involve inputting real-time data, inputting real-time GPS data, inputting real-time cellular data, inputting real-time RFID data, inputting real-time Bluetooth data, inputting real-time WiFi data, inputting real-time golf course conditions data, inputting real-time ambient temperature data, inputting real-time ambient humidity data, inputting real-time weather data, and inputting real-time golf course position data.

Also as shown in FIG. 9, the cover (2) in various embodiments also may utilize data storage (212). Storage may be generally known and understood in the technical field described herein, and may involve any storage, memory or the like suitable for storing data that may be utilized consistent with the inventive principles discussed herein, and in various embodiments may include random access memory, EDO RAM, SRAM, DRAM, DDR RAM, read only memory, PROM, EPROM, EEPROM, flash memory, NAND flash memory, hard disk drives, solid state drives, tape drives, optical drives, CD drives, DVD drives, floppy disks, memory chips, digital memory, analog memory, memory hardware, memory software, volatile memory, non-volatile memory, local storage, cloud storage, and the like. Data storage (212) may be implemented in any manner otherwise consistent with the inventive principles discussed herein, and in some embodiments may be part of a cover (2), part of an input module (101), may be self-contained with the cover (2), or may utilize components separate from the cover, such as a golfer's smartphone or other similar handheld device, or such as hardware or software that may be accessed via connection to a networked environment.

Accordingly, embodiments may involve a data storage (212) of a cover (2) responsive to a data input (210) of a cover (2) and configured to store golf round data (211), and may involve the step of storing input golf round data (211) in a data storage (212) of a cover (2).

With further reference to FIG. 9, the cover (2) in various embodiments also may utilize a data processor (213). Processors may be generally known and understood for the technical field described herein, and may be understood to include hardware and/or software that receives golf round data (211) that is input and provides processed golf round data (216) that is changed in condition, nature, or character, for example by modifying it, adding to it, subtracting from it, and the like. In some embodiments, a data processor (213) may be a CPU, an algorithm, a series of logic functions, or the like, and embodiments may involve processing with a data processor (213), processing with a CPU, processing with an algorithm, and processing with a series of logic functions. Examples of processed golf round data (216) may include:

Inner warmth area (24) temperature advice (such as advice on what the temperature of an inner warmth area (24) is, advice on a recommended temperature for an inner warmth area (24), and the like).

Sectioned inner warmth area temperature advice (such as advice on what the temperature of a section of a sectioned inner warmth area (207) is, advice on a recommended temperature for a sectioned inner warmth area (207), and the like).

Ambient temperature advice (such as advice on the ambient temperature, advice on a forecast ambient temperature, and the like).

Inner warmth area humidity advice (such as advice on what the humidity of an inner warmth area (24) is, advice on a recommended humidity for an inner warmth area (24), and the like).

Sectioned inner warmth area humidity advice (such as advice on what the humidity of a section of a sectioned inner warmth area (207) is, advice on a recommended humidity for a sectioned inner warmth area (207), and the like).

Ambient humidity advice (such as advice on the ambient humidity, advice on a forecast ambient humidity, and the like).

Frequently used golf club advice (such as advice on the most frequently used golf club in a past number of rounds, the most frequently used golf club used to tee off for a given hole of a given golf course, and the like).

Golf club selection advice (such as advice on a recommended club to use based on yardage and par information for a given hole on a given golf course, advice on a recommended golf club to use based on golfer historical performance, and the like).

Golf ball elasticity advice (such as advice on the degree to which ball elasticity may be reduced due to given temperature conditions).

Golf club grip feel advice (such as advice on increased shock feel due to given temperature conditions).

Golf club shaft stiffness advice (such as advice on increased stiffness to due given temperature conditions).

Golf club face elasticity advice (such as advice on decreased elasticity due to given temperature conditions).

Golf ball distance advice (such as advice on reduced travel distance of struck golf balls due to given temperature conditions).

Golf ball spin advice (such as advice on reduced golf ball spin due to given temperature conditions).

Golf round data advice (such as advice on gameplay statistics for given golf courses at which a cover (2) is being used).

Real-time data advice (such as advice on changing weather conditions or changing golf course conditions).

Embodiments accordingly may involve providing inner warmth area (24) temperature advice, providing sectioned inner warmth area (24) temperature advice, providing ambient temperature advice, providing inner warmth area (24) humidity advice, providing sectioned inner warmth area (24)

humidity advice, providing ambient humidity advice, providing frequently used golf club advice, providing golf club selection advice, providing inner warmth area (24) temperature advice, providing golf ball elasticity advice, providing golf club grip feel advice, providing golf club shaft stiffness advice, providing golf club face elasticity advice, providing golf ball distance advice, providing golf ball spin advice, and providing real-time data advice.

Advice may be understood to include generally any information or notice provided to a golfer. It may be appreciated that given the wide variety of golf round data (216) disclosed as falling within the scope of the present invention in various embodiments, a data processor (213) may be programmed, configured, or otherwise made to provide a great variety of processed golf round data (216) advice. Such advice may span the range from the very simple (such as a simple readout of ambient and inner warmth area (24) temperatures, and which may require a very simple data processing architecture) to the very sophisticated (such as a recommendation of a specific golf club to use for a given shot that takes into account hole information, weather conditions, the temperatures of the golf club and the golf ball, the biometrics of the golfer, and the golfer's handicap, and which may require a more complex data processing architecture). Of course, all foregoing examples are illustrative only, and should not be construed to limit the broad scope of the inventive principles disclosed related to the processing of data described herein. Accordingly, embodiments may involve a data processor (213) of a cover (2) responsive to a data storage (212) of a cover (2) and configured to process golf round data (211), and may involve the step of processing stored golf round data (211) with a data processor (213) for a cover (2).

Again with reference to FIG. 9, the cover (2) in various embodiments may utilize a golf gameplay aid (223). A golf gameplay aid (223) may be anything that utilizes processed golf round data (216) in a manner to aid the gameplay of a golfer, and embodiments may involve aiding the gameplay of a golfer with processed golf round data (216). For example, in some embodiments a golf gameplay aid (223) may be a golfer advice output (215), and aiding the gameplay of a golfer may involve providing advice to a golfer, such as based on processed golf round data (216). A golfer advice output (215) may be anything that communicates advice (such as described elsewhere herein) to a golfer, and embodiments may involve the step of providing advice to a golfer based, for example, on processed golf round data (216). In some embodiments, a golfer advice output (215) may be golfer interface hardware, such as screens, touch screens, displays, speakers, headphones, headsets, GPS devices, smartphones, handheld devices, and the like. Embodiments accordingly may involve providing advice via golfer interface hardware. The golf gameplay aid (223) and the golfer advice output (215) may be implemented in any manner otherwise consistent with the inventive principles discussed herein, and in embodiments may be part of a cover (2), part of an input module (101), may be self-contained with the cover (2), or may utilize components separate from the cover, such as a golfer's smartphone or other similar handheld device, or such as hardware or software that may be accessed via connection to a networked environment.

In some embodiments a golfer advice output (215) may be an automated closure system actuator (206) of a cover (2) configured to open and close an automated closure system (205) of the cover (2) to present an advised golf club (209). An advised golf club (209) may be the golf club within the complement of clubs enclosed by the cover (2) that may be determined to be most suitable for a given golf shot. In various embodiments, the determination of an advised golf club (209) may be advice based on processed golf round data (216) as may be described elsewhere herein. In some embodiments, an inner warmth area (24) of a cover (2) may be a sectioned inner warmth area (207) of the cover (2), and the automated closure system actuator (206) may be an actuator configured to open and close the automated closure system (208) for the section having the advised golf club (209). In this manner, it may be seen that temperature, humidity, or other conditions inside the cover (2) may not be disrupted for the sections having clubs not advised. Embodiments accordingly may involve actuating an automated closure system (205) of a cover (2) to present and advised golf club (209), and actuating an automated closure system (205) of a cover (2) to present an advised golf club (209) within a section of a sectioned inner warmth area (24) of a cover (2).

Embodiments may involve a golf gameplay aid (223) of a cover (2) responsive to a data processor (213) of the cover (2) and configured to utilize said processed golf round data (216), and in some embodiments, a golf gameplay aid (223) may be a golfer advice output (215) of a cover (2) responsive to a data processor (213) and configured to output processed golf round data (211).

In some embodiments, a golf gameplay aid (223) may be one or more thermostats (214) of a cover (2) responsive to a data processor (213) of the cover (2) and to which one or more heat sources (204) are responsive, and embodiments may involve aiding the gameplay of a golfer, such as by adjusting a temperature of at least one inner warmth area (24) based on golf round data (211). The thermostat or thermostats (214) may raise, lower, or otherwise regulate the temperature in one or more inner warmth areas (24) or sectioned inner warmth areas (208) by controlling the appropriate heat source or heat sources (204), and embodiments accordingly may involve the step of adjusting a temperature of at least one inner warmth area (24), for example in some embodiments based on processed golf round data (216). The utilization of a thermostat or thermostats (214) in this manner may be seen to be an aid to golfer gameplay in as much as achieving desired temperatures in relevant inner warmth areas (24) or sectioned inner warmth areas (208) may warm equipment to have desired gameplay characteristics. In this manner, embodiments may disclose a thermostat (214) configured to change a temperature within said inner warmth area (24) of said cover (2), a thermostat (214) configured to change a humidity within said inner warmth area (24) of said cover (2), a thermostat (214) configured to promote a desired golf ball elasticity, a thermostat (214) configured to promote a desired golf club grip feel, a thermostat (214) configured to promote a desired golf club shaft stiffness, a thermostat (214) configured to promote a desired golf club face elasticity, a thermostat (214) configured based on said golf round data (211), and the like. Embodiments accordingly may involve adjusting a temperature of an inner warmth area (24) of a cover (2) with at least one thermostat (214), adjusting a humidity of an inner warmth area (24) of a cover (2) with at least one thermostat (214), promoting a desired golf ball elasticity by adjusting a temperature, promoting a desired golf club grip feel by adjusting a temperature, promoting a desired golf club shaft stiffness by adjusting a temperature, promoting a desired golf club face elasticity by adjusting a temperature, and adjusting a temperature based on golf round data (211).

In some embodiments, a thermostat (214) may function as a golfer advice output (215). For example, a golfer advice output (215) may be one or more thermostats (214) of a cover (2) configured to vary a temperature of an inner warmth area (24) based on processed golf round data (216). In further embodiments, an inner warmth area (24) of a cover (2) may be a sectioned inner warmth area (207) of the cover (2), and one or more thermostats (214) may be a thermostat or thermostats (214) configured to vary a temperature among two or more sections of the sectioned inner warmth area (207). Embodiments accordingly may involve varying a temperature of at least one inner warmth area (24) based on processed golf round data (216) and/or varying a temperature among sections of a sectioned inner warmth area (207) of a cover (2).

In some embodiments, a golf gameplay aid (223) may be an automated closure system actuator (206) of a cover (2) responsive to a data processor (213) of the cover (2) and configured to open or close an automated closure system (205) of a cover (2). Such automated opening and closing of the cover may be effected to aid the gameplay of a golfer in a variety of manners. Embodiments naturally may involve aiding the gameplay of a golfer by actuating an automated closure system (205) of a cover (2) based on processed golf round data (216). Examples of the manners in which such automated opening and closing may be a gameplay aid may include:

an actuator (206) configured to open and close an automated closure system (205) of a cover (2) to affect a temperature within said inner warmth area (24) of a cover (2). For example, a temperature in the inner warmth area (24) may be raised or lowered to create desired performance effects for golf equipment such as golf clubs and golf balls, as may be described elsewhere herein. The step of actuating naturally may involve affecting a temperature within an inner warmth area (24) of a cover (2) for various embodiments.

an actuator (206) configured to open and close an automated closure system (205) of a cover (2) to affect a humidity within an inner warmth area (24) of a cover (2). For example, a humidity in the inner warmth area (24) may be raised or lowered to create desired performance effects for golf equipment such as golf clubs and golf balls, as may be described elsewhere herein. The step of actuating naturally may involve affecting a humidity within an inner warmth area (24) of a cover (2) for various embodiments.

an actuator (206) configured to open and close an automated closure system (205) to expose or shelter an inner warmth area (24) of a cover (2) to or from a weather condition. For example, it may desirable to shield golf equipment in the inner warmth area (24) from adverse weather such as rain, or it may be desirable to expose golf equipment to favorable weather, such as warm, dry air. The step of actuating naturally may involve exposing or sheltering an inner warmth area (24) of a cover (2) to or from a weather condition for various embodiments.

an actuator (206) configured to open and close an automated closure system (205) to promote a desired golf ball elasticity. For example, opening or closing the cover (2) may promote regulation of temperature, humidity, or the like within the cover (2) that may facilitate a desired golf ball elasticity. The step of actuating naturally may involve promoting a desired golf ball elasticity for various embodiments.

an actuator (206) configured to open and close an automated closure system (205) to promote a desired golf club grip feel. For example, opening or closing the cover (2) may promote regulation of temperature, humidity, or the like within the cover (2) that may facilitate a desired golf club grip feel. The step of actuating naturally may involve promoting a desired golf club grip feel for various embodiments.

an actuator (206) configured to open and close an automated closure system (205) to promote a desired golf club shaft stiffness. For example, opening or closing the cover (2) may promote regulation of temperature, humidity, or the like within the cover (2) that may facilitate a desired golf club shaft stiffness. The step of actuating naturally may involve promoting a desired golf club shaft stiffness for various embodiments.

an actuator (206) configured to open and close an automated closure system (205) to promote a desired golf club face elasticity. For example, opening or closing the cover (2) may promote regulation of temperature, humidity, or the like within the cover (2) that may facilitate a desired golf club face elasticity. The step of actuating naturally may involve promoting a desired golf club face elasticity for various embodiments.

an actuator (206) configured to open and close an automated closure system (205) based on golf round data (216). For example, golf round data (216), as may be described elsewhere herein, may embody various kinds of information informing what may be desirable temperature, humidity, or other conditions for golf equipment in a golf bag (201), and the cover (2) may be opened or closed in whole or in part based on the same. The step of actuating naturally may involve actuating based on golf round data (211).

Of course, all foregoing examples are illustrative only, and should not be construed to limit the broad scope of the inventive principles disclosed related to the manners in which such automated opening and closing may aid gameplay.

Figure 4A:
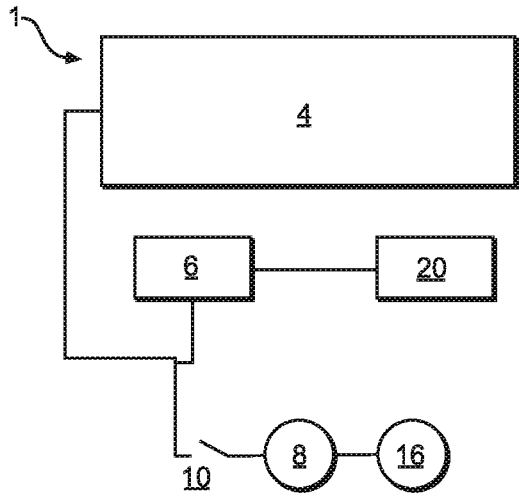
FIG. 4A is an exemplary diagram of one embodiment of a heating system component layout.
Figure 4B:
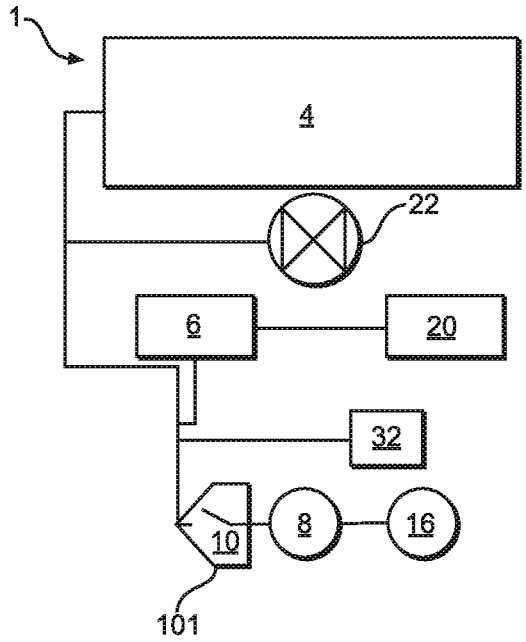
FIG. 4B is an exemplary diagram of another embodiment of a heating system component layout.

With reference to FIGS. 4A, 4B, and 9, embodiments may utilize an input module (101), as such may described elsewhere herein. It should be understood that some or all of a data input (210), golf round data (211), data storage (212), a data processor (213), a thermostat (214), a golfer advice output (215), processed golf round data (216), temperature sensors, humidity sensors, and a golf gameplay aid (223) may be configured to be part of an input module (101) in some embodiments. However, it also should be understood that some or all of these elements may be capable of implementation separately from an input module (101), and that various embodiments may utilize the foregoing elements without an input module (101), or may utilize an input module (101) in the absence of some or all of the foregoing elements. It also may be understood that certain embodiments may omit an input module (101) and all of the foregoing elements entirely, and accomplish some or all of the functions of the input module (101) and the foregoing elements using alternative techniques. For example, in the absence of input module (101) or the foregoing elements, certain of the heating functions described herein may be executable with, for example, a controller circuit for a heating element, and various other of the functions described herein may be analogously accomplished with controller circuits, circuit architectures, and the like.

With reference to FIGS. 1, 3, 4A and 4B, in certain embodiments, the present invention may also include an easy access input (10) to allow a golfer or other user to initiate the heating element with the simple press of one button to cycle through heating options. In one embodiment, an easy access input (10) may enable the user to select from predetermined heating values or input a user-defined heating value that may be in but is not limited to the range of 60 to 100 degrees F. In some embodiments, the heating value range may be increased to the maximum heating value the system can reach if desired. In one embodiment, this may be a switch, dial, or button, and in another may be an input module (101, as shown in FIG. 4B). An input module (101) may consist of varying sensors and/or user identified conditions. The input module (101) may be a collection of sensors or conditions that may be input from an operator. The input module (101) may consist of internal temperature sensors and external temperature sensors. These temperature sensors may be but are not limited to, thermocouples, resistance temperature detectors, thermistors, semiconductor-based integrated circuits, or analog thermometers. The input module (101) may utilize a humidity sensor that may measure the internal and external environmental conditions. The humidity sensor may be but is not limited to, a resistive type sensor, a capacitive type sensor, a thermal conductive type sensor, or operator visual input. In some embodiments, it may be beneficial to utilize an input module as an easy access input (10) in order to adjust heating parameters to optimize the heating characteristics of the elements for player optimized performance. Various users may prefer varying temperatures based on user-provided metrics, such as, but not limited to, ball distance, ball spin, club feel, and/or club shaft stiffness. Inputs from varying sensors may be beneficial to allow for system shutoff if external temperatures increase to the desired level to conserve power source energy. This may be the case in some environments where a golf round begins in cooler temperatures, and then as the round progresses, the day warms. It also may be beneficial for a golfer that plays a late (in the day) round and as the temperature drops, the heating system may automatically power on with a change in temperature. The data input into the input module may then be transferred or input to a central processing unit. The central processing unit may be utilized to analyze the combined metrics from the input module, or it may be a decision-making step performed by the golfer. In certain embodiments, the central processing unit may utilize a series of algorithms or logic functions to make a decision on whether to power the system on, power the system off, or hold the system at an optimally desired temperature.

Alternative embodiments of the present invention may include the capability to be adjustable and adaptable to fit any size golf bag, from small carry bags to large tour staff bags, as but two non-limiting examples. Adjustability and adaptability may be beneficial in some embodiments where the user requires the ability to transfer the system from one bag to another. As an example, the user may have multiple bags and require the ability to transfer the system between a carry bag, a stand bag, and but not limited to a cart bag. To secure the outside cover (2) to a golf bag, an easy secure clip (12) may be utilized. This easy secure clip (12) may be, but is not limited to, an interlocking clip, hooks, a magnetic clip, or a variety of other clip components. This may allow the cover to be used seasonally or potentially transferred to another bag. An easy secure clip (12) also may be utilized in conjunction with an adjustable heat seal (18), and in some embodiments an adjustable heat seal (18) may be or utilize an easy secure clip (12) and may involve adjusting an easy secure clip heat seal (18). An easy secure clip (12) may also secure the heating system of golf bag cover for improved golf ball and club performance (1) from loss when transferring from bag to bag, bag from vehicle to playing destination, or when in use, and may be used to attach and detach the hood from the bag. Some embodiments may include an adjustable closure (26) to easily allow the outside cover (2) to conform to any size bag. The adjustable closure may be, but is not limited to, a hook and loop strap, adjustable webbing, an adjustable strap, a drawstring, an elastic cord, a magnetic closure, or a snap closure to make it adaptable to any size bag and possibly to ensure a tight seal to keep warm air trapped in the golf bag for optimal performance. In some embodiments, the outside cover (2) may be fully sealable to allow no outside air to penetrate the internal. In other embodiments, the outside cover may be substantially scalable to allow for easier installation and removal, allowing a universal fit. In this embodiment, there may be some gaps in the seal; providing the gap does not exceed three square inches. To ensure optimal heating performance, it may be beneficial to keep the scalable gap as small as possible. This heating system of a golf bag cover for improved golf ball and club performance (1) could be present in another type of heating system of a golf bag cover for improved golf ball and club performance (1) and is not limited to the embodiment described herein.

In various embodiments, a cover (2) may have one or more heat sources (204). Heat sources may involve any things capable of applying heat to an area consistent with the inventive principles discussed herein, such as for example resistance wire-based, ceramic-based, semiconductor-based, resistive thick film based, PTC polymer-based, chemical-based, or liquid-based heat sources. In some embodiments, a heat source (204) may be an internal heating element (4) as may be described herein. Embodiments may involve applying heat to various areas of a cover (2) of a golf bag (201), such as an inner warmth area (24) of a cover (2), a sectioned inner warmth area (207) of a cover (2), an inner warmth area (24) of a pouch (6), an inner warmth area (24) of a cold ball heated pouch (20), and the like. Naturally, a temperature within the area to which heat is applied may be set or changed by such application of heat, such as for example to raise a temperature to a desired value by the application of heat, to lower a temperature to a desired value by the withdrawal of applied heat, and so forth. Accordingly, embodiments may involve a main heat source (204) of a cover (2) configured to apply heat to an inner warmth area (24) of a cover (2), or even more generally a heat source (204) of a cover (2) configured to apply heat to an inner warmth area (24) of the cover (2), and may involve the step of applying heat to an inner warmth area (24) of a cover (2) having at least one golf club head (202) received therewithin.

Alternative embodiments of the present invention, such as shown in FIG. 2 is an exemplary cross-sectional illustration of one embodiment of an interior structure of a heating system of golf bag cover for improved golf ball and club performance. In one embodiment, an internal heating element (4) may be arranged in a coil, and in other embodiments may be arranged in a linear fashion, as but two non-limiting examples. The internal heating element may be but is not limited to, a resistance wire-based, a ceramic-based, a semiconductor-based, a resistive thick film based, a PTC polymer-based, a chemical-based, or a liquid-based heating element. An inner warming area or inner warmth area (24) may trap warm air and allow a place for club heads or other equipment to be positioned inside the outside cover (2) to ensure optimal heating. Embodiments accordingly may include an inner warmth area (24) of a cover (2) configured to receive therewithin at least one golf club head (202), as shown for example in FIGS. 5, 7, and 8, and may involve receiving at least one golf club head (202) within an inner warmth area (24) of a cover (2) as a result of the step of enclosing.

Figure 6:
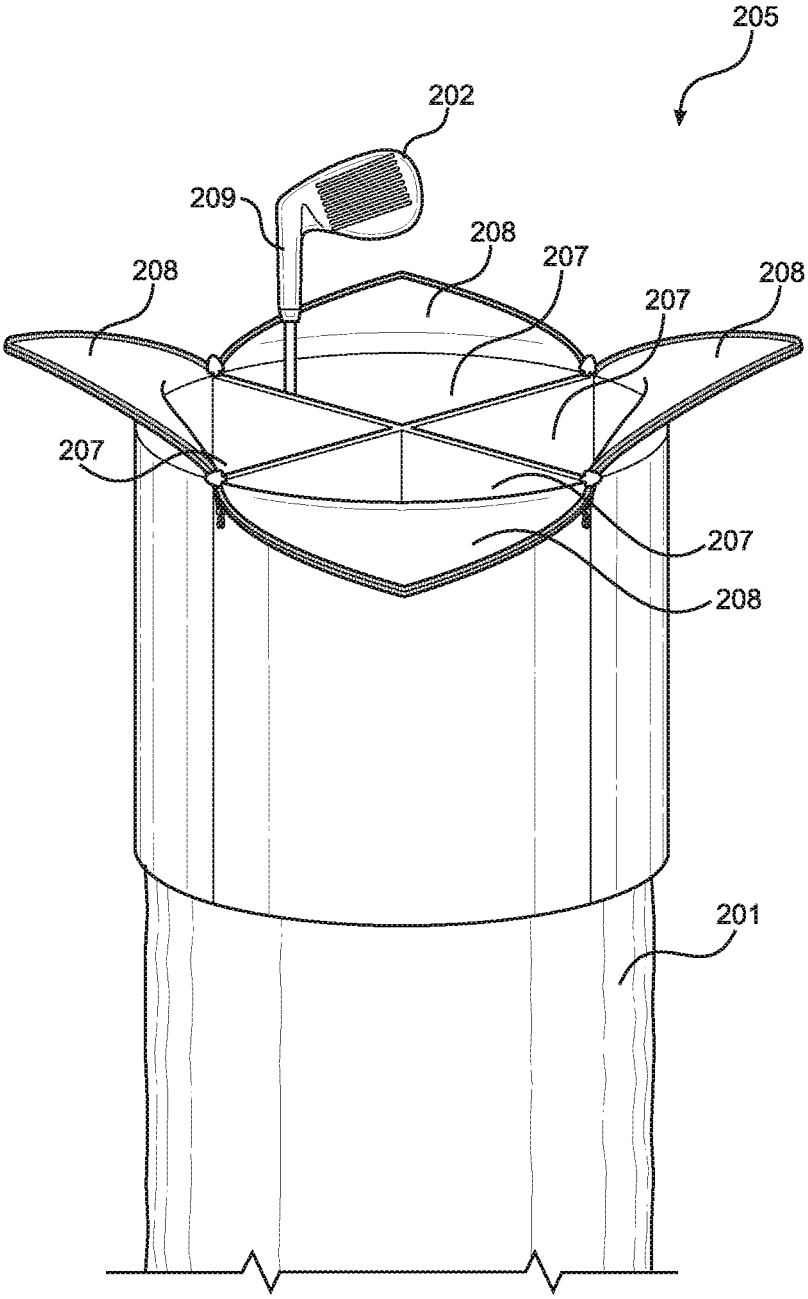
FIG. 6 is an exemplary illustration in a perspective view for one embodiment of an automated closure system in an open position.
Figure 7:
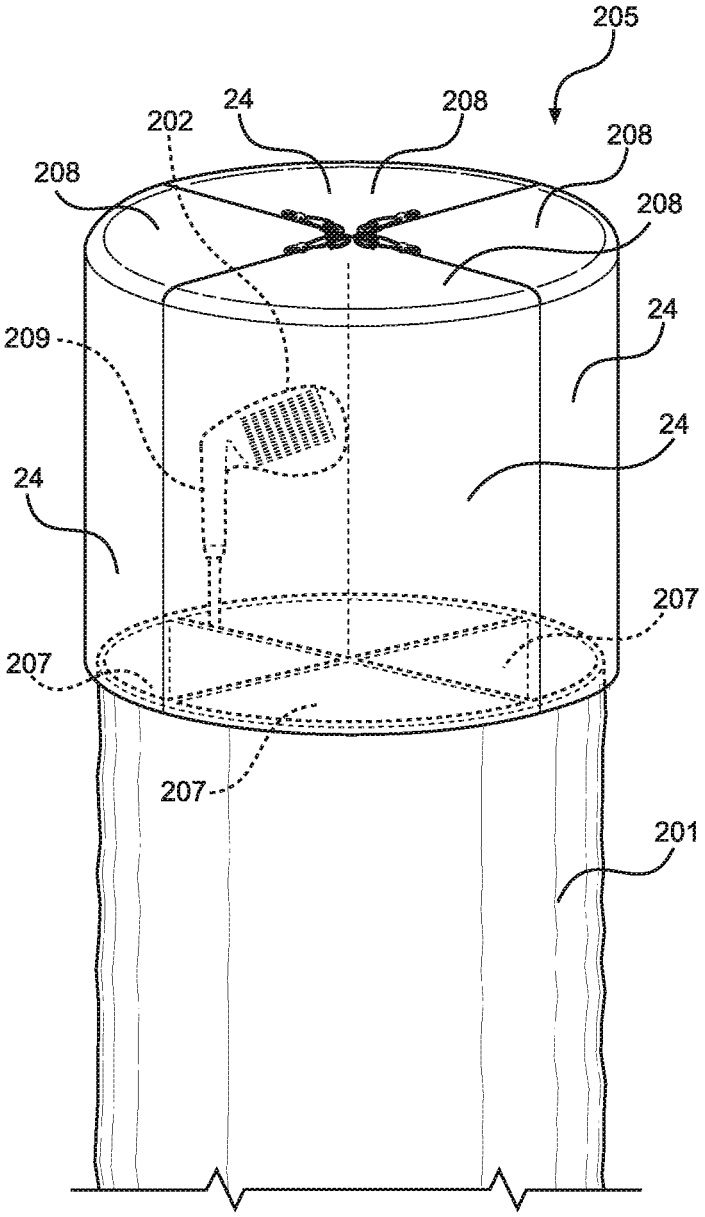
FIG. 7 is an exemplary illustration in perspective view for one embodiment of an automated closure system in a closed position for one embodiment.
Figure 8:
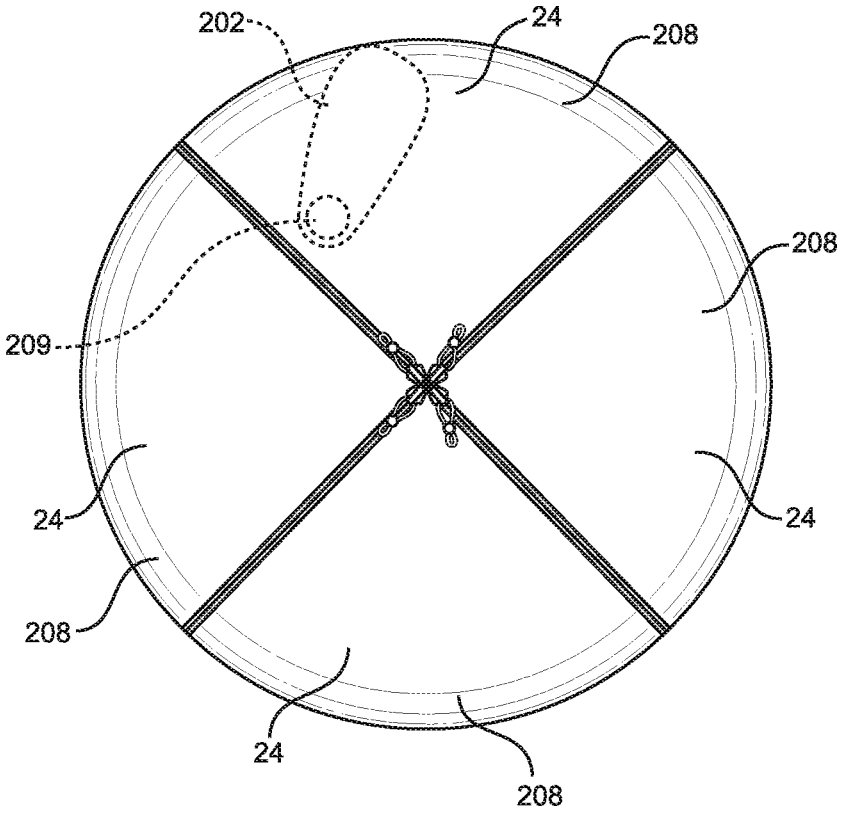
FIG. 8 is an exemplary illustration in top-down view in one embodiment of a sectioned golf bag cover.

With reference to FIGS. 6, 7, and 8, an inner warmth area (24) of a cover (2) in some embodiments may be a sectioned inner warmth area (207). This may involve partitioning the interior of the cover (2) to create two or more wholly or partially enclosed compartments such that each compartment may be capable of receiving and enclosing therewithin one or more golf clubs separately from a club or clubs received and enclosed within another compartment. In the manner, it may be seen that sectioned inner warmth areas (207) may be able to, among other things, create separate environments for golf clubs received in each section as opposed to that of golf clubs received in other sections. For example, in some embodiments, a sectioned inner warmth area (207) of a cover (2) may be a temperature varied sectioned inner warmth area (207).

In some embodiments, a cover (2) having a sectioned inner warmth area (207) may have at least one section of the sectioned inner warmth area (207) that is a frequent use section of the sectioned inner warmth area (207). This may be a section where frequently used golf equipment, such as frequently used golf clubs, may be stored. As the frequent use of such equipment may mean the frequent withdrawal and replacement of such equipment from a golf bag (201), having a dedicated frequent use section for such equipment may tend to support maintenance of desired temperature, humidity, or other conditions in other sections of the cover (2) by segregating the most frequently used golf equipment to one section of the cover (2). Some embodiments may involve actuating a sectioned automated closure system (208) for a frequent use section of a sectioned inner warmth area (207) of a cover (2).

As discussed above, with reference to FIGS. 1 and 2, a heated ball pouch (6) and cold ball heated pouch (20) may be accessed internally, externally, or both. Heated pouches (6) (20) each naturally may have an inner warmth area (24) of the pouch, for example such that a heated ball pouch (6) may have an inner warmth area (24) and a cold ball heated pouch (20) may have an inner warmth area (24). Embodiments accordingly may involve an inner warmth area (24) of each golf ball pouch (6) (20) configured to receive therewithin at least one golf ball (224), and embodiments may involve the step of receiving at least one golf ball (224) within each of at least two golf ball pouched (6) (20) disposed inside a cover (2). The heated ball pouch (6) and cold ball heated pouch (20) may utilize similar heat sources (204) and heating elements as the internal heating element (4) those may include, but are not limited to, a resistance wire-based, a ceramic-based, a semiconductor-based, a resistive thick film based, a PTC polymer-based, a chemical-based, or liquid-based heating elements. Heating pouches (6) (20) may be considered in some embodiments to be auxiliary to the main heating function for the inner warmth area (24) of the cover (2), and heat sources (204) for pouches (6) (20) may be considered to be auxiliary heat sources (204). Accordingly, embodiments may include an auxiliary heat source (204) of each golf ball pouch (6) configured to apply heat to an inner warmth area (24) of each such golf ball pouch (6) (20), and may involve applying heat to an inner warmth area (24) of each golf ball pouch (6) (20) having at least one golf ball (224) received therewithin.

In another embodiment, it may be beneficial for the heated ball pouches to be held at a different temperature selected by the user. Embodiments accordingly may involve at least two golf ball pouches (6) (20) as temperature varied golf ball pouches (6) (20), and may involve varying the temperature of at least two such golf ball pouches (6) (20). In addition to heating golf balls, the heated ball pouches may be able to provide a secondary heat source for the inner warming or inner warmth area (24) of a cover (2), allowing excess heat to be trapped and utilized to aid in warming the golf clubs. Other items of equipment such as tees, gloves, ball markers, or the like may also be warmed in the pouches. In some embodiments, the pouches may be insulated in order to keep the balls at an optimal temperature; this may be beneficial when playing in hot environments where ball performance may decrease if the temperature outside the pouch is warmer than the pouch temperature. In some embodiments, a heated ball pouch (6) and a cold ball heated pouch (20) may include an automatic closure system that closes automatically once a ball is removed from the pouch. This automatic closure system may be but is not limited to a spring component, a counterweighted mechanical linkage, a magnetic closure, a computer-controlled electrical component utilizing motors, sensors, and computer-readable media. In some embodiments, the heating pouches may also include a warming pouch for a user's hands to be inserted into if cold while waiting for other golfers. This may increase performance by allowing the golfer to be more comfortable in colder conditions.

Figure 5:
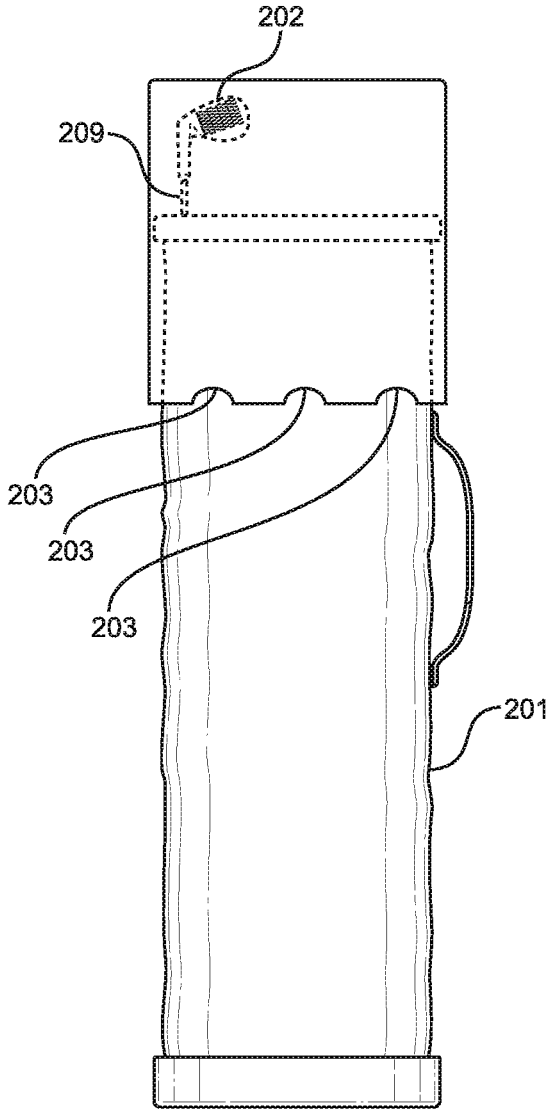
FIG. 5 is an exemplary illustration of a side view in one embodiment of a golf bag cover situated on a golf bag.

With reference to FIGS. 2 and 5, in some embodiments, to aid in the internal warming effect, a heat seal (18) may be present. This seal may be a natural or polymer seal that may create a better seal than the adjustable closure (26) alone. This heat seal may conform to the bag and allow a greater variety of bags to be used in combination with the heating system. Embodiments accordingly may include a heat seal (18) of a cover (2) configured to conform to the top end of a golf bag (201), and may involve the step of heat sealing a cover (2) to the top end of a golf bag (201).

A heat seal (18) may be an adjustable heat seal (18), as wherein the circumference, length, or the like of the heat seal may be adjusted to fit or conform to golf bags (201) having different sizes or irregular shapes. An adjustable heat seal (18) may be of any kind or configuration otherwise consistent with the inventive principles described herein, and in various embodiments may be any or any combination of a hook and loop heat seal (18), a strap heat seal (18), a webbing heat seal (18), a drawstring heat seal (18), an elastic heat seal (18), a magnetic heat seal (18), a snap heat seal (18), a heat seal (18) configured to conform to a golf bag (201), a heat seal (18) separate from an adjustable closure (26) of a golf bag (201), a natural heat seal (18), and a polymer heat seal (18). Accordingly, embodiments may involve adjusting a heat seal (18), adjusting a hook and loop heat seal (18), adjusting a strap heat seal (18), adjusting a webbing heat seal (18), adjusting a drawstring heat seal (18), adjusting an elastic heat seal (18), adjusting a magnetic heat seal (18), adjusting a snap heat seal (18), adjusting a heat seal (18) configured to conform to a golf bag (201), adjusting a heat seal (18) separate from an adjustable closure (26) of a golf bag (201), adjusting a natural heat seal (18), and adjusting a polymer heat seal (18).

An adjustable heat seal (18) in various embodiments may be a fully scalable adjustable heat seal (18), such as wherein the heat seal may be adjustable to fully or totally seal to the surface of a golf bag (201), or may be a substantially scalable adjustable heat seal (18), such as wherein the heat seal may not fully or totally seal to the surface of a golf bag (201). A substantially scalable adjustable heat seal (18) nevertheless still may minimize heat loss from an inner warmth area (24). For example, a substantially scalable adjustable heat seal (18) may be understood to have one or more gaps (203) between the seal and the surface of the golf bag (201). Such gaps (203) may be configured to minimize heat loss from an inner warmth area (24) of a cover (2), and in some embodiments a substantially scalable adjustable heat seal (18) may be configured for no gap (203) to exceed three square inches. Accordingly, embodiments may involve adjusting a heat seal (18) to fully conform to a top end of a golf bag (201), adjusting a heat seal (18) to substantially conform to the top end of a golf bag (201), adjusting a heat seal (18) to have gaps that minimize heat loss from an inner warmth area (24) of a cover (2), and adjusting a heat seal (18) to have no gap exceeding three square inches.

Referring to FIGS. 1 and 2, in some embodiments, the primary and secondary power sources (8, 16) may be internal to the system and may include a charge port or retractable charge cable visible from the outside of the heating system. In some embodiments, it may be beneficial for the power sources to be internal in some embodiments because by generating power, the excess energy will be dissipated as heat. In other embodiments, the waste heat may be calculated into the total heat dissipated by the heating elements to calculate optimal performance of the heating system and to ensure other parameters such as system weight and packaging are met.

Figure 3:
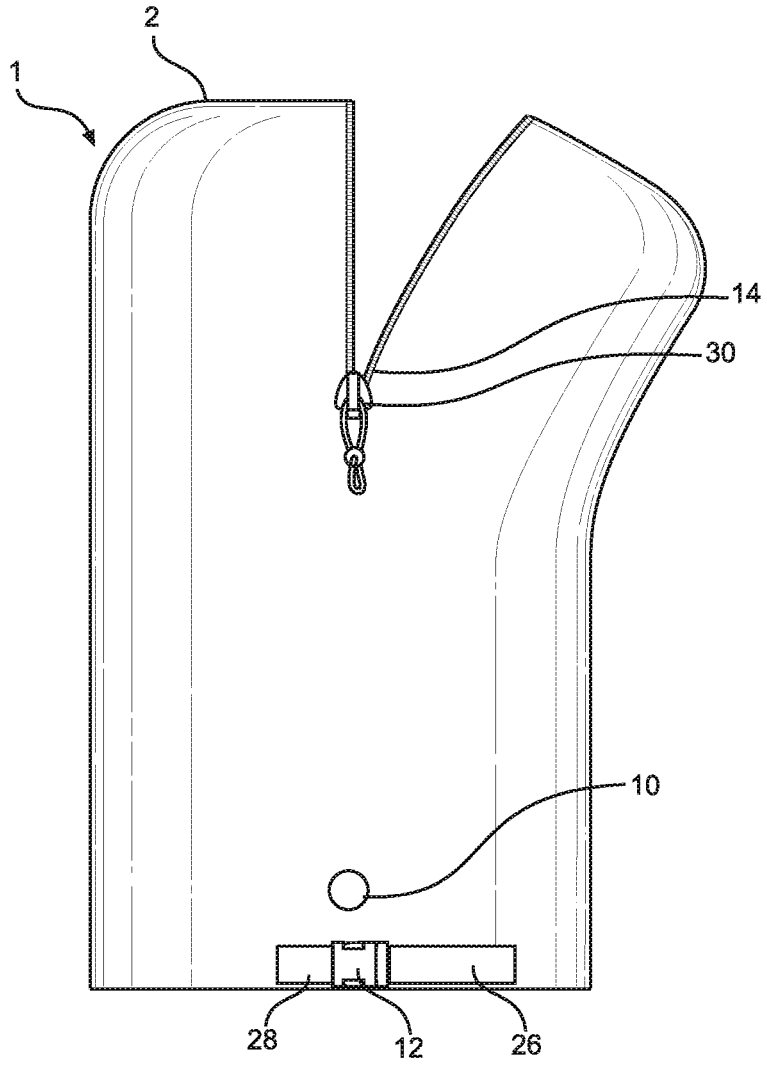
FIG. 3 is an exemplary illustration of one embodiment of a rapid closure system for a heating system of a golf bag cover for improved golf ball and club performance.

FIG. 3 is an exemplary illustration of one embodiment of a rapid closure system for a heating system of golf bag cover for improved golf ball and club performance. The rapid closure system (14) may be beneficial to aid the golfer in accessing clubs, balls, or other items of equipment during play, possibly with gloves on. The rapid closure system (14) may be weather resistant or waterproof and scalable to ensure optimal heating of the club heads and shafts. In another embodiment, it may be beneficial for the rapid closure system (14) to be able to open completely to allow the golfer easy clear access to the clubs or other equipment.

In some embodiments, the rapid closure system (14) may be programmed to open automatically based on user input through the easy access input (10) or through a Bluetooth application. In other embodiments, the easy access input (10) may contain a control for the rapid closure system (14). As an example, this may include a button or touch screen that would allow the golfer to open and close the rapid closure system (14).

As some users may prefer different types of clubs or other equipment to be heated at various temperatures, a rapid closure system (14) may also be split or otherwise sectioned into quadrants or other sections, for example, one for irons, wedges, hybrids, woods, and drivers. Utilizing separate compartments, sections, or access points may ensure that each club or other equipment item maintains an optimal temperature when not in use and while another club or item of equipment is accessed.

In some embodiments, it may be beneficial to utilize quadrants or other sections with varying temperatures. Clubs that are used more frequently may need to be held at a higher or different temperature because the outer cover is being opened, releasing internal heat, and the clubs are being exposed to the out-of-bag environment more often, cooling at a higher rate than clubs remaining in the bag. In some embodiments, the quadrants, sections, or separate compartments may be held at varying temperatures based on desired club performance.

Referring to FIGS. 6, 7, and 9, some embodiments may involve an automated closure system (205) of a cover (2). The automated closure system (205) generally may open and close the access to the cover (2) in an automated fashion, such as without a golfer manually performing such opening and closing. The automated closure system (205) may of any kind or nature otherwise consistent with the inventive principles disclosed herein, and in various embodiments may be a motorized automated closure system (205), a spring loaded automated closure system (205), a mechanical automated closure system (205), a counterweighted automated closure system (205), a magnetic automated closure system (205), an electrical automated closure system (205), a computer controlled automated closure system (205), and the like. The automated closure system (205) may be responsive to manual input by a golfer, such as based on user input, a manually operated control, or the like, or may automatically perform such opening and closing based on other, non-manually entered input, certain examples of which may be described elsewhere herein.

The automated closure system (205) in some embodiments may utilize an automated closure system actuator (206), which may be a device or other thing providing power, movement, or other suitable control to effect the automated opening and closing of the automated closure system (205). In various embodiments, pouches such as golf pouches (6) (20) may utilize automatic closure systems (205) in like fashions. Embodiments accordingly may involve actuating an automated closure system (205) of a cover (2), such as based on golf round data (211), and may involve actuating a motorized automated closure system (205), actuating a spring loaded automated closure system (205), actuating a mechanical automated closure system (205), actuating a counterweighted automated closure system (205), actuating a magnetic automated closure system (205), actuating an electrical automated closure system (205), actuating a computer controlled automated closure system (205), and the like.

An automated closure system (205) in various embodiments may be configured to minimize communication between an inner warmth area (24), such as of a cover (2) or a golf ball pouch (6) (20), and the ambient environment, such as outside of a cover (2) or a golf ball pouch (6) (20). For example, the automated closure system (205) may ensure a cover (2) or a pouch (6) (20) is in a closed state except when necessary to access golf equipment, which may tend to support the maintenance of a desired temperature, humidity, or other condition within the cover or pouch that may confer a performance advantage to golf equipment stored therein. Embodiments accordingly may involve actuating an automated closure system (205) for minimizing communication between an inner warmth area (24) of a cover (2) and the ambient environment outside of the cover (2).

In some embodiments, an inner warmth area (24) of a cover (2) may be a sectioned inner warmth area (207) of a cover (2), and an automated closure system (205) may be a sectioned automated closure system (205). A sectioned automated closure system (205) may enable the automatic opening and closing of specific sections of such a cover (2) while keeping the cover closed for other sections. This again may tend to support the maintenance of a desired temperature, humidity, or other condition within the closed sections of the cover (2) while the section in use is opened. Accordingly, embodiments may involve actuating a sectioned automated closure system (208) of a cover (2), and may involve actuating a sectioned automated closure system (208) for a temperature varied sectioned inner warmth area (24) of a cover (2).

In some embodiments, it may be beneficial for the outer insulated cover (2) to be breathable to ensure that if clubs are returned to the bag wet, that mildew, mold, corrosion, or other undesirable conditions may not develop within the bag as they may possibly ruin equipment, which may have adverse effects on both the golfer's performance and the performance of the heating system (1).

In some embodiments, an input module could receive course and/or conditions data from either GPS, cellular, RFID, or but not limited to Bluetooth. This may enable customization of the heating system (1) by a user to, for example, control the rapid closure system (14), including opening and closing the system automatically based on course position. In an embodiment with separate club group compartments inside the system, the input module could be programmed to receive course data and automatically open the rapid closure system (14) compartment with the optimal club for the length of the shot, the golfer's ability and/or preferences, and course conditions.

With reference to FIGS. 1 and 3, the heating system (1) and the outside insulated cover (2) may be attached to the golf bag with the bag clip (12) and weather and heat secured by the adjustable closure (26). In some embodiments, to better serve the traveling golfer, a bag lock (28) and a rapid closure system lock (30) may be utilized to help keep the golfer's personal belongings safe and secure. In some embodiments, the bag lock (28) may be integrated into the bag clip (12), or in other embodiments may be a secure loop, such as but not limited to a metal cable, allowing the golfer to place a locking device between the cover and the bag. In some embodiments, a rapid closure system lock (30) may be integrated into the rapid closure system through computer control locking mechanisms. In other embodiments, the rapid closure system lock (30) may be cables or loops as mentioned above to allow the golfer to lock the rapid closure system (14) using a locking device, such as but not limited to a combination lock, biometric lock, or keyed lock. In some embodiments, utilizing a computer-controlled electronic rapid closure system (14), the rapid closure system lock (30) may be controlled through an application on a cellular phone or other devices capable of being connected to the bag through Wi-Fi or Bluetooth.

FIG. 4A and FIG. 4B show exemplary diagrams of multiple embodiments of the heating system component layout. In some embodiments, the heating system (1) may be a separate system from the outside cover (2) to be combined with travel hoods that may accompany some golf bags. Heating systems (1) included in these embodiments may have the same or substantially similar main components as other embodiments, those being but not limited to a primary or main heating element (4), a ball warming element (6), a cold ball warming element (20), a tee warming element, an easy access input (10), a primary power source (8), and a secondary power source (16). In some embodiments, the easy access input may include an input module (101) that may consist of varying sensors, possibly consistent with those as described herein. In some embodiments, it may be beneficial to include a circulation component (22), such as but not limited to a fan or other type of blower to move excess heat produced by the primary or main heating element (4) from the inner warming or inner warmth area (24) to all areas in the golf bag to obtain more uniform club head and club shaft heating profile. Embodiments accordingly may involve a circulation component (22) configured to circulate heat from an inner warmth area (24) of a cover (2) to the body of a golf bag (201), and may involve the step of circulating heat from an inner warmth area (24) of a cover (2) to the body of a golf bag (201). In some embodiments, such as where an input module (101) is present, the input module (101) may be a processor-controlled system or could be based on a series of logic functions to control the heating system. The input module (101) may be a Bluetooth sensor that connects to a smartphone app to control the power on, power off, open, and/or close functions, as but a few examples, of the heating system (1). As previously discussed, the input module (101) may also receive data from the course via GPS, Bluetooth, or RFID, or similar, and may enable the input module to act as a virtual caddie to assist the golfer's performance. In some embodiments, club selection may be displayed on a readout, an audible signal may be given, or the outside cover may open automatically, presenting club, tee, ball maker, or any combination thereof. This processor-controlled system may also be controlled based on but not limited to varying metrics, such as golfer handicap, average temperature, club shaft material, club head material, club type, ball type, and the like. In some embodiments, there may be an audible alarm or visual indicator that alerts the user when power is switched between the primary power source (8) and the secondary power source (16). In some embodiments, utilizing Wi-Fi or Bluetooth connectivity, the alarm may be a notification on the user's connected device. Other functions may be available if the heating system is connected to a user's device. An application such as a cellular phone application may be able to control the activation of the heating system remotely, allow the user to select a desired and optimal temperature for the heating system, and open and close the differing pouches and rapid closure system. In some embodiments, the primary and secondary power sources may also be connected to a power output (32), such as but not limited to a USB port. Such a power output may be useful to charge a cellular phone, range finder, portable speaker, or other portable electronics. The power output (32) may have circuitry, such as but not limited to an inverter, enabling both AC and DC power to be output.

While the present invention has been described in connection with some preferred embodiments, it is not intended to limit the scope of the invention to the particular form set forth, but on the contrary, it is intended to cover such alternatives, modifications, and equivalents, as may be included within the spirit and scope of the invention as defined by the statements of inventions. Examples of alternative claims may include:

1. A heated cover for a golf bag comprising:
   - a cover configured to enclose the top end of a golf bag;
   - a heat seal of said cover configured to conform to said top end of said golf bag;
   - an inner warmth area of said cover configured to receive therewithin at least one golf club head;
   - a main heat source of said cover configured to apply heat to said inner warmth area of said cover;
   - at least two golf ball pouches of said cover disposed inside said cover;
   - an inner warmth area of each said golf ball pouch configured to receive therewithin at least one golf ball;
   - an auxiliary heat source of each said golf ball pouch configured to apply heat to said inner warmth area of said golf ball pouch;
   - a data input of said cover configured for input of golf round data;
   - a data storage of said cover responsive to said data input of said cover and configured to store said golf round data;
   - a data processor of said cover responsive to said data storage of said cover and configured to process said golf round data;

at least one thermostat of said cover responsive to said data processor of said cover and to which at least one said heat source is responsive;

a golfer advice output of said cover responsive to said data processor of said cover and configured to output processed golf round data;

at least one power source of said cover to which each said heat source, said data input, said data storage, said data processor, each said thermostat, and said golfer advice output are responsive.

2. A heated cover for a golf bag as described in clause 1 or any other clause, wherein said cover comprises a cover selected from the group consisting of an insulated cover, a waterproof cover, a one removeable piece cover, a lightweight cover, a portable cover, a reusable cover, a breathable cover, and a quick change cover.

3. A heated cover for a golf bag as described in clause 1 or any other clause, further comprising a circulation component configured to circulate heat from said inner warmth area of said cover to the body of said golf bag.

4. A heated cover for a golf bag as described in clause 1 or any other clause, wherein said heat seal comprises an adjustable heat seal.

5. A heated cover for a golf bag as described in clause 4 or any other clause, wherein said adjustable heat seal comprises a heat seal selected from the group consisting of a hook and loop heat seal, a strap heat seal, a webbing heat seal, a drawstring heat seal, an elastic heat seal, a magnetic heat seal, and a snap heat seal.

6. A heated cover for a golf bag as described in clause 4 or any other clause, wherein said adjustable heat seal comprises an easy secure clip.

7. A heated cover for a golf bag as described in clause 6 or any other clause, wherein said easy secure clip comprises an easy secure clip selected from the group consisting of an interlocking clip, a hook clip, and a magnetic clip.

8. A heated cover for a golf bag as described in clause 4 or any other clause, wherein said adjustable heat seal comprises a fully sealable adjustable heat seal.

9. A heated cover for a golf bag as described in clause 4 or any other clause, wherein said adjustable heat seal comprises a substantially sealable adjustable heat seal.

10. A heated cover for a golf bag as described in clause 9 or any other clause, wherein said substantially sealable adjustable heat seal comprises a heat seal selected from the group consisting of a heat seal configured to have gaps that minimize heat loss from said inner warmth area of said cover and a heat seal configured for no gap to exceed three square inches.

11. A heated cover for a golf bag as described in clause 4 or any other clause, wherein said adjustable heat seal comprises a heat seal selected from the group consisting of a heat seal configured to conform to said golf bag, a heat seal separate from an adjustable closure of said golf bag, a natural heat seal, and a polymer heat seal.

12. A heated cover for a golf bag as described in clause 1 or any other clause, further comprising an automated closure system actuator of said cover responsive to said data processor of said cover and configured to open or close an automated closure system of said cover.

13. A heated cover for a golf bag as described in clause 12 or any other clause, wherein said automated closure system comprises an automated closure system selected from the group consisting of a motorized automated closure system, a spring loaded automated closure system, a mechanical automated closure system, a counterweighted automated closure system, a magnetic automated closure system, an electrical automated closure system, and a computer controlled automated closure system.

14. A heated cover for a golf bag as described in clause 12 or any other clause, wherein said automated closure system comprises an automated closure system configured to minimize communication between said inner warmth area of said cover and the ambient environment outside of said cover.

15. A heated cover for a golf bag as described in clause 12 or any other clause, wherein said inner warmth area of said cover comprises a sectioned inner warmth area of said cover, and or any other clause, wherein said automated closure system comprises a sectioned automated closure system.

16. A heated cover for a golf bag as described in clause 15 or any other clause, wherein said sectioned inner warmth area of said cover comprises a temperature varied sectioned inner warmth area of said cover.

17. A heated cover for a golf bag as described in clause 16 or any other clause, wherein at least one section of said sectioned inner warmth area of said cover comprises a frequent use section of said sectioned inner warmth area of said cover.

18. A heated cover for a golf bag as described in clause 1 or any other clause, wherein said at least two golf ball pouches comprise cold contamination prevention golf ball pouches.

19. A heated cover for a golf bag as described in clause 1 or any other clause, wherein said at least two golf ball pouches comprise accelerated warming golf ball pouches.

20. A heated cover for a golf bag as described in clause 1 or any other clause, wherein said inner warmth area of each said golf ball pouch comprises an additional heat source for said inner warmth area of said cover.

21. A heated cover for a golf bag as described in clause 1 or any other clause, wherein said at least two golf ball pouches comprise temperature varied golf ball pouches.

22. A heated cover for a golf bag as described in clause 1 or any other clause, wherein said data input comprises a manual data input.

23. A heated cover for a golf bag as described in clause 1 or any other clause, wherein said data input comprises an automated data input.

24. A heated cover for a golf bag as described in clause 22 or 23 or any other clause, wherein said data input comprises a data input responsive to at least one temperature sensor.

25. A heated cover for a golf bag as described in clause 24 or any other clause, wherein said at least one temperature sensor comprises at least one internal temperature sensor and at least one external temperature sensor.

26. A heated cover for a golf bag as described in clause 24 or any other clause, wherein said at least one temperature sensor comprises multiple section-specific temperature sensors.

27. A heated cover for a golf bag as described in clause 22 or 23 or any other clause, wherein said data input comprises a data input responsive to at least one humidity sensor.

28. A heated cover for a golf bag as described in clause 27 or any other clause, wherein said at least one humidity sensor comprises at least one internal humidity sensor and at least one external humidity sensor.

29. A heated cover for a golf bag as described in clause 27 or any other clause, wherein said at least one humidity sensor comprises multiple section-specific humidity sensors.

30. A heated cover for a golf bag as described in clause 1 or any other clause, wherein said golf round data comprises golfer handicap data.

31. A heated cover for a golf bag as described in clause 1 or any other clause, wherein said golf round data comprises golfer biometrics data.

32. A heated cover for a golf bag as described in clause 1 or any other clause, wherein said golf round data comprises golf club head data.

33. A heated cover for a golf bag as described in clause 1 or any other clause, wherein said golf round data comprises golf club shaft data.

34. A heated cover for a golf bag as described in clause 1 or any other clause, wherein said golf round data comprises golf club grip data.

35. A heated cover for a golf bag as described in clause 1 or any other clause, wherein said golf round data comprises golf club type data.

36. A heated cover for a golf bag as described in clause 1 or any other clause, wherein said golf round data comprises golf club make data.

37. A heated cover for a golf bag as described in clause 1 or any other clause, wherein said golf round data comprises golf ball data.

38. A heated cover for a golf bag as described in clause 1 or any other clause, wherein said golf round data comprises golf ball spin data.

39. A heated cover for a golf bag as described in clause 1 or any other clause, wherein said golf round data comprises golf ball distance data.

40. A heated cover for a golf bag as described in clause 1 or any other clause, wherein said golf round data comprises golf course gameplay data.

41. A heated cover for a golf bag as described in clause 1 or any other clause, wherein said golf round data comprises golfer preference data.

42. A heated cover for a golf bag as described in clause 1 or any other clause, wherein said golf round data comprises real-time data.

43. A heated cover for a golf bag as described in clause 42 or any other clause, wherein said real-time data comprises real-time data selected from the group consisting of real-time GPS data, real-time cellular data, real-time RFID data, real-time Bluetooth data, and real-time WiFi data.

44. A heated cover for a golf bag as described in clause 42 or any other clause, wherein said real-time data comprises real-time golf course conditions data.

45. A heated cover for a golf bag as described in clause 42 or any other clause, wherein said real-time data comprises real-time ambient temperature data.

46. A heated cover for a golf bag as described in clause 42 or any other clause, wherein said real-time data comprises real-time ambient humidity data.

47. A heated cover for a golf bag as described in clause 42 or any other clause, wherein said real-time data comprises real-time weather data.

48. A heated cover for a golf bag as described in clause 42 or any other clause, wherein said real-time data comprises real-time golf course position data.

49. A heated cover for a golf bag as described in clause 1 or any other clause, wherein said data processor comprises a data processor selected from the group consisting of a CPU, an algorithm, and a series of logic functions.

50. A heated cover for a golf bag as described in clause 12 or any other clause, wherein said automated closure system actuator comprises an actuator configured to open and close said automated closure system of said cover to affect a temperature within said inner warmth area of said cover.

51. A heated cover for a golf bag as described in clause 1 or any other clause, wherein said automated closure system actuator comprises an actuator configured to open and close said automated closure system of said cover to affect a humidity within said inner warmth area of said cover.

52. A heated cover for a golf bag as described in clause 1 or any other clause, wherein said automated closure system actuator comprises an actuator configured to open and close said automated closure system to expose or shelter said inner warmth area of said cover to or from a weather condition.

53. A heated cover for a golf bag as described in clause 1 or any other clause, wherein said automated closure system actuator comprises an actuator configured to open and close said automated closure system to promote a desired golf ball elasticity.

54. A heated cover for a golf bag as described in clause 1 or any other clause, wherein said automated closure system actuator comprises an actuator configured to open and close said automated closure system to promote a desired golf club grip feel.

55. A heated cover for a golf bag as described in clause 1 or any other clause, wherein said automated closure system actuator comprises an actuator configured to open and close said automated closure system to promote a desired golf club shaft stiffness.

56. A heated cover for a golf bag as described in clause 1 or any other clause, wherein said automated closure system actuator comprises an actuator configured to open and close said automated closure system to promote a desired golf club face elasticity.

57. A heated cover for a golf bag as described in clause 1 or any other clause, wherein said automated closure system actuator comprises an actuator configured to open and close said automated closure system based on said golf round data.

58. A heated cover for a golf bag as described in clause 1 or any other clause, wherein said at least one thermostat of said cover comprises a thermostat configured to change a temperature within said inner warmth area of said cover.

59. A heated cover for a golf bag as described in clause 1 or any other clause, wherein said at least one thermostat of said cover comprises a thermostat configured to change a humidity within said inner warmth area of said cover.

60. A heated cover for a golf bag as described in clause 1 or any other clause, wherein said at least one thermostat of said cover comprises thermostat configured to promote a desired golf ball elasticity.

61. A heated cover for a golf bag as described in clause 1 or any other clause, wherein said at least one thermostat of said cover comprises thermostat configured to promote a desired golf club grip feel.

62. A heated cover for a golf bag as described in clause 1 or any other clause, wherein said at least one thermostat of said cover comprises thermostat configured to promote a desired golf club shaft stiffness.

63. A heated cover for a golf bag as described in clause 1 or any other clause, wherein said at least one thermostat of said cover comprises thermostat configured to promote a desired golf club face elasticity.

64. A heated cover for a golf bag as described in clause 1 or any other clause, wherein said at least one thermostat of said cover comprises thermostat configured based on said golf round data.

65. A heated cover for a golf bag as described in clause 1 or any other clause, wherein said golfer advice output of said cover comprises golfer interface hardware.

66. A heated cover for a golf bag as described in clause 1 or any other clause, wherein said golfer advice output comprises said automated closure system actuator of said cover configured to open and close said automated closure system of said cover to present an advised golf club.

67. A heated cover for a golf bag as described in clause 66 or any other clause, wherein said inner warmth area of said cover comprises a sectioned inner warmth area of said cover, and or any other clause, wherein said actuator comprises an actuator configured to open and close said automated closure system for said section having said advised golf club.

68. A heated cover for a golf bag as described in clause 1 or any other clause, wherein said golfer advice output comprises said at least one thermostat of said cover configured to vary a temperature of said inner warmth area based on said processed golf round data.

69. A heated cover for a golf bag as described in clause 68, or any other clause, wherein said inner warmth area of said cover comprises a sectioned inner warmth area of said cover, and or any other clause, wherein said at least one thermostat comprises at least one thermostat configured to vary a temperature among said sections of said sectioned inner warmth area.

70. A heated cover for a golf bag as described in clause 1 or any other clause, wherein said processed golf round data comprises inner warmth area temperature advice.

71. A heated cover for a golf bag as described in clause 1 or any other clause, wherein said processed golf round data comprises sectioned inner warmth area temperature advice.

72. A heated cover for a golf bag as described in clause 1 or any other clause, wherein said processed golf round data comprises ambient temperature advice.

73. A heated cover for a golf bag as described in clause 1 or any other clause, wherein said processed golf round data comprises inner warmth area humidity advice.

74. A heated cover for a golf bag as described in clause 1 or any other clause, wherein said processed golf round data comprises sectioned inner warmth area humidity advice.

75. A heated cover for a golf bag as described in clause 1 or any other clause, wherein said processed golf round data comprises ambient humidity advice.

76. A heated cover for a golf bag as described in clause 1 or any other clause, wherein said processed golf round data comprises frequently used golf club advice.

77. A heated cover for a golf bag as described in clause 1 or any other clause, wherein said processed golf round data comprises golf club selection advice.

78. A heated cover for a golf bag as described in clause 1 or any other clause, wherein said processed golf round data comprises advice selected from the group consisting of golf ball elasticity advice, golf club grip feel advice, golf club shaft stiffness advice, golf club face elasticity advice, golf ball distance advice, and golf ball spin advice.

79. A heated cover for a golf bag as described in clause 1 or any other clause, wherein said processed golf round data comprises golf round data advice.

80. A heated cover for a golf bag as described in clause 1 or any other clause, wherein said processed golf round data comprises real-time data advice.

81. A method for heating the cover of a golf bag comprising the steps of:

enclosing the top end of a golf bag with a cover;

receiving at least one golf club head within an inner warmth area of said cover as a result of said step of enclosing;

heat sealing said cover to said top end of said golf bag;

applying heat to said inner warmth area of said cover having at least one golf club head received therewithin;

receiving at least one golf ball within each of at least two golf ball pouches disposed inside said cover;

applying heat to an inner warmth area of each said golf ball pouch having at least one golf ball received therewithin;

inputting golf round data into a data input for said cover;

storing said input golf round data in a data storage for said cover;

processing said stored golf round data with a data processor for said cover;

adjusting a temperature of at least one said inner warmth area based on said processed golf round data;

providing advice to a golfer based on said processed golf round data.

82. A method for heating the cover of a golf bag as described in clause 81 or any other clause, wherein said cover comprises a cover selected from the group consisting of an insulated cover, a waterproof cover, a one removeable piece cover, a lightweight cover, a portable cover, a reusable cover, a breathable cover, and a quick change cover.

83. A method for heating the cover of a golf bag as described in clause 81 or any other clause, further comprising the step of circulating heat from said inner warmth area of said cover to the body of said golf bag.

84. A method for heating the cover of a golf bag as described in clause 81 or any other clause, wherein said step of heat sealing comprises the step of adjusting said heat seal.

85. A method for heating the cover of a golf bag as described in clause 84 or any other clause, wherein said step of adjusting comprises a step selected from the group consisting of adjusting a hook and loop heat seal, adjusting a strap heat seal, adjusting a webbing heat seal, adjusting a drawstring heat seal, adjusting an elastic heat seal, adjusting a magnetic heat seal, and adjusting a snap heat seal.

86. A method for heating the cover of a golf bag as described in clause 84 or any other clause, wherein said step of adjusting comprises the step of adjusting an easy secure clip heat seal.

87. A method for heating the cover of a golf bag as described in clause 86 or any other clause, wherein said easy secure clip comprises an easy secure clip selected from the group consisting of an interlocking clip, a hook clip, and a magnetic clip.

88. A method for heating the cover of a golf bag as described in clause 84 or any other clause, wherein said step of adjusting comprises the step of adjusting said heat seal to fully conform to said top end of said golf bag.

89. A method for heating the cover of a golf bag as described in clause 84 or any other clause, wherein said step of adjusting comprises the step of adjusting said heat seal to substantially conform to said top end of said golf bag.

90. A method for heating the cover of a golf bag as described in clause 89 or any other clause, wherein said step of adjusting said heat seal to substantially conform comprises the step of adjusting said heat seal to have gaps that minimize heat loss from said inner warmth area of said cover and adjusting said heat seal to have no gap exceeding three square inches.

91. A method for heating the cover of a golf bag as described in clause 84 or any other clause, wherein said step of adjusting comprises a step selected from the group consisting of adjusting said heat seal to conform to a golf bag, adjusting said heat seal separate from an adjustable closure of said golf bag, adjusting a natural heat seal, and adjusting a polymer heat seal.

92. A method for heating the cover of a golf bag as described in clause 81 or any other clause, further comprising the step of actuating an automated closure system of said cover based on said processed golf round data.

93. A method for heating the cover of a golf bag as described in clause 92 or any other clause, wherein said step of actuating comprises a step selected from the group consisting of actuating a motorized automated closure system, actuating a spring loaded automated closure system, actuating a mechanical automated closure system, actuating a counterweighted automated closure system, actuating a magnetic automated closure system, actuating an electrical automated closure system, and actuating a computer controlled automated closure system.

94. A method for heating the cover of a golf bag as described in clause 92 or any other clause, wherein said step of actuating comprises the step of minimizing communication between said inner warmth area of said cover and the ambient environment outside of said cover.

95. A method for heating the cover of a golf bag as described in clause 92 or any other clause, wherein said inner warmth area of said cover comprises a sectioned inner warmth area of said cover, and or any other clause, wherein said step of actuating comprises the step of actuating a sectioned automated closure system of said cover.

96. A method for heating the cover of a golf bag as described in clause 95 or any other clause, wherein said step of actuating comprises the step of actuating said sectioned automated closure system for a temperature varied sectioned inner warmth area of said cover.

97. A method for heating the cover of a golf bag as described in clause 96 or any other clause, wherein said step of actuating comprises the step of actuating said sectioned automated closure system for a frequent use section of said sectioned inner warmth area of said cover.

98. A method for heating the cover of a golf bag as described in clause 81 or any other clause, wherein said step of receiving at least one golf ball within each of at least two golf ball pouches comprises the step of preventing cold contamination of at least one said golf ball pouch.

99. A method for heating the cover of a golf bag as described in clause 81 or any other clause, wherein said step of receiving at least one golf ball within each of at least two golf ball pouches comprises the step of accelerating the warming of at least one said golf ball.

100. A method for heating the cover of a golf bag as described in clause 81 or any other clause, wherein said step of applying heat to an inner warmth area of each said golf ball pouch comprises the step of additionally applying heat to said inner warmth area of said cover.

101. A method for heating the cover of a golf bag as described in clause 81 or any other clause, wherein said step of applying heat to an inner warmth area of each said golf ball pouch comprises the step of varying the temperature of at least two said golf ball pouches.

102. A method for heating the cover of a golf bag as described in clause 81 or any other clause, wherein said step of inputting golf round data comprises the step of manually inputting golf round data.

103. A method for heating the cover of a golf bag as described in clause 81 or any other clause, wherein said step of inputting golf round data comprises the step of automatically inputting golf round data.

104. A method for heating the cover of a golf bag as described in clause 102 or 103 or any other clause, wherein said step of imputing golf round data comprises the step of inputting temperature data.

105. A method for heating the cover of a golf bag as described in clause 104 or any other clause, wherein said step of inputting temperature data comprises the step of inputting internal temperature data and external temperature data.

106. A method for heating the cover of a golf bag as described in clause 104 or any other clause, wherein said step of inputting temperature data comprises the step of inputting multiple section-specific temperature data.

107. A method for heating the cover of a golf bag as described in clause 102 or 103 or any other clause, wherein said step of inputting golf round data comprises the step of inputting humidity data.

108. A method for heating the cover of a golf bag as described in clause 107 or any other clause, wherein said step of inputting humidity data comprises the step of inputting internal humidity data and external humidity data.

109. A method for heating the cover of a golf bag as described in clause 107 or any other clause, wherein said step of inputting humidity data comprises the step of inputting multiple section-specific humidity data.

110. A method for heating the cover of a golf bag as described in clause 81 or any other clause, wherein said step of inputting golf round data comprises the step of inputting golfer handicap data.

111. A method for heating the cover of a golf bag as described in clause 81 or any other clause, wherein said step of inputting golf round data comprises the step of inputting golfer biometrics data.

112. A method for heating the cover of a golf bag as described in clause 81 or any other clause, wherein said step of inputting golf round data comprises the step of inputting golf club head data.

113. A method for heating the cover of a golf bag as described in clause 81 or any other clause, wherein said step of inputting golf round data comprises the step of inputting golf club shaft data.

114. A method for heating the cover of a golf bag as described in clause 81 or any other clause, wherein said step of inputting golf round data comprises the step of inputting golf club grip data.

115. A method for heating the cover of a golf bag as described in clause 81 or any other clause, wherein said step of inputting golf round data comprises the step of inputting golf club type data.

116. A method for heating the cover of a golf bag as described in clause 81 or any other clause, wherein said step of inputting golf round data comprises the step of inputting golf club make data.

117. A method for heating the cover of a golf bag as described in clause 81 or any other clause, wherein said step of inputting golf round data comprises the step of inputting golf ball data.

118. A method for heating the cover of a golf bag as described in clause 81 or any other clause, wherein said step of inputting golf round data comprises the step of inputting golf ball spin data.

119. A method for heating the cover of a golf bag as described in clause 81 or any other clause, wherein said step of inputting golf round data comprises the step of inputting golf ball distance data.

120. A method for heating the cover of a golf bag as described in clause 81 or any other clause, wherein said step of inputting golf round data comprises the step of inputting golf course gameplay data.

121. A method for heating the cover of a golf bag as described in clause 81 or any other clause, wherein said step of inputting golf round data comprises the step of inputting golfer preference data.

122. A method for heating the cover of a golf bag as described in clause 81 or any other clause, wherein said step of inputting golf round data comprises the step of inputting real-time data.

123. A method for heating the cover of a golf bag as described in clause 122 or any other clause, wherein said step of inputting real-time data comprises a step selected from the group consisting of inputting real-time GPS data, inputting real-time cellular data, inputting real-time RFID data, inputting real-time Bluetooth data, and inputting real-time WiFi data.

124. A method for heating the cover of a golf bag as described in clause 122 or any other clause, wherein said step of inputting real-time data comprises the step of inputting real-time golf course conditions data.

125. A method for heating the cover of a golf bag as described in clause 122 or any other clause, wherein said step of inputting real-time data comprises the step of inputting real-time ambient temperature data.

126. A method for heating the cover of a golf bag as described in clause 122 or any other clause, wherein said step of inputting real-time data comprises the step of inputting real-time ambient humidity data.

127. A method for heating the cover of a golf bag as described in clause 122 or any other clause, wherein said step of inputting real-time data comprises the step of inputting real-time weather data.

128. A method for heating the cover of a golf bag as described in clause 122 or any other clause, wherein said step of inputting real-time data comprises the step of inputting real-time golf course position data.

129. A method for heating the cover of a golf bag as described in clause 81 or any other clause, wherein said step of processing comprises a step selected from the group consisting of processing with a data processor, processing with a CPU, processing with an algorithm, and processing with a series of logic functions.

130. A method for heating the cover of a golf bag as described in clause 92 or any other clause, wherein said step of actuating comprises the step of affecting a temperature within said inner warmth area of said cover.

131. A method for heating the cover of a golf bag as described in clause 92 or any other clause, wherein said step of actuating comprises the step of affecting a humidity within said inner warmth area of said cover.

132. A method for heating the cover of a golf bag as described in clause 92 or any other clause, wherein said step of actuating comprises the step of exposing or sheltering said inner warmth area of said cover to or from a weather condition.

133. A method for heating the cover of a golf bag as described in clause 92 or any other clause, wherein said step of actuating comprises the step of promoting a desired golf ball elasticity.

134. A method for heating the cover of a golf bag as described in clause 92 or any other clause, wherein said step of actuating comprises the step of promoting a desired golf club grip feel.

135. A method for heating the cover of a golf bag as described in clause 92 or any other clause, wherein said step of actuating comprises the step of promoting a desired golf club shaft stiffness.

136. A method for heating the cover of a golf bag as described in clause 92 or any other clause, wherein said step of actuating comprises the step of promoting a desired golf club face elasticity.

137. A method for heating the cover of a golf bag as described in clause 92 or any other clause, wherein said step of actuating comprises the step of actuating based on said golf round data.

138. A method for heating the cover of a golf bag as described in clause 81 or any other clause, wherein said step of adjusting a temperature comprises the step of adjusting a temperature of said inner warmth area of said cover with at least one thermostat.

139. A method for heating the cover of a golf bag as described in clause 81 or any other clause, wherein said step of adjusting a temperature comprises the step of adjusting a humidity of said inner warmth area of said cover with at least one thermostat.

140. A method for heating the cover of a golf bag as described in clause 81 or any other clause, wherein said step of adjusting a temperature comprises the step of promoting a desired golf ball elasticity.

141. A method for heating the cover of a golf bag as described in clause 81 or any other clause, wherein said step of adjusting a temperature comprises the step of promoting a desired golf club grip feel.

142. A method for heating the cover of a golf bag as described in clause 81 or any other clause, wherein said step of adjusting a temperature comprises the step of promoting a desired golf club shaft stiffness.

143. A method for heating the cover of a golf bag as described in clause 81 or any other clause, wherein said step of adjusting a temperature comprises the step of promoting a desired golf club face elasticity.

144. A method for heating the cover of a golf bag as described in clause 81 or any other clause, wherein said step of adjusting a temperature comprises the step of adjusting a temperature based on said golf round data.

145. A method for heating the cover of a golf bag as described in clause 81 or any other clause, wherein said step of providing advice comprises the step of providing advice via golfer interface hardware.

146. A method for heating the cover of a golf bag as described in clause 81 or any other clause, wherein said step of providing advice comprises the step of actuating an automated closure system of said cover to present an advised golf club.

147. A method for heating the cover of a golf bag as described in clause 146 or any other clause, wherein said step of providing advice comprises the step of actuating an automated closure system of said cover to present an advised golf club within a section of a sectioned inner warmth area of said cover.

148. A method for heating the cover of a golf bag as described in clause 81 or any other clause, wherein said step of providing advice comprises the step of varying a temperature of at least one said inner warmth area based on said processed golf round data.

149. A method for heating the cover of a golf bag as described in clause 148 or any other clause, wherein said step of varying a temperature comprises the step of varying a temperature among sections of a sectioned inner warmth area of said cover.

150. A method for heating the cover of a golf bag as described in clause 81 or any other clause, wherein said step of providing advice comprises the step of providing inner warmth area temperature advice.

151. A method for heating the cover of a golf bag as described in clause 81 or any other clause, wherein said step of providing advice comprises the step of providing sectioned inner warmth area temperature advice.

152. A method for heating the cover of a golf bag as described in clause 81 or any other clause, wherein said step of providing advice comprises the step of providing ambient temperature advice.

153. A method for heating the cover of a golf bag as described in clause 81 or any other clause, wherein said step of providing advice comprises the step of providing inner warmth area humidity advice.

154. A method for heating the cover of a golf bag as described in clause 81 or any other clause, wherein said step of providing advice comprises the step of providing sectioned inner warmth area humidity advice.

155. A method for heating the cover of a golf bag as described in clause 81 or any other clause, wherein said step of providing advice comprises the step of providing ambient humidity advice.

156. A method for heating the cover of a golf bag as described in clause 81 or any other clause, wherein said step of providing advice comprises the step of providing frequently used golf club advice.

157. A method for heating the cover of a golf bag as described in clause 81 or any other clause, wherein said step of providing advice comprises the step of providing golf club selection advice.

158. A method for heating the cover of a golf bag as described in clause 81 or any other clause, wherein said step of providing advice comprises the step of providing inner warmth area temperature advice.

159. A method for heating the cover of a golf bag as described in clause 81 or any other clause, wherein said step of providing advice comprises a step selected from the group consisting of providing golf ball elasticity advice, providing golf club grip feel advice, providing golf club shaft stiffness advice, providing golf club face elasticity advice, providing golf ball distance advice, and providing golf ball spin advice.

160. A method for heating the cover of a golf bag as described in clause 81 or any other clause, wherein said step of providing advice comprises the step of providing real-time data advice.

161. A heated golfer assist cover for a golf bag comprising:

a cover configured to enclose the top end of a golf bag;

an inner warmth area of said cover configured to receive therewithin at least one golf club head;

a heat source of said cover configured to apply heat to said inner warmth area of said cover;

a data input of said cover configured for input of golf round data;

a data storage of said cover responsive to said data input of said cover and configured to store said golf round data;

a data processor of said cover responsive to said data storage of said cover and configured to process said golf round data;

a golf gameplay aid of said cover responsive to said data processor of said cover and configured to utilize said processed golf round data;

at least one power source for said cover to which said heat source, said data input, said data storage, said data processor and said golf gameplay aid are responsive.

162. A heated golfer assist cover for a golf bag as described in clause 161 or any other clause, wherein said data input comprises a manual data input.

163. A heated golfer assist cover for a golf bag as described in clause 161 or any other clause, wherein said data input comprises an automated data input.

164. A heated golfer assist cover for a golf bag as described in clause 163 or any other clause, wherein said data input comprises a data input responsive to at least one temperature sensor.

165. A heated golfer assist cover for a golf bag as described in clause 164 or any other clause, wherein said at least one temperature sensor comprises at least one internal temperature sensor and at least one external temperature sensor.

166. A heated golfer assist cover for a golf bag as described in clause 164 or any other clause, wherein said at least one temperature sensor comprises multiple section-specific temperature sensors.

167. A heated golfer assist cover for a golf bag as described in clause 163 or any other clause, wherein said data input comprises a data input responsive to at least one humidity sensor.

168. A heated golfer assist cover for a golf bag as described in clause 167 or any other clause, wherein said at least one humidity sensor comprises at least one internal humidity sensor and at least one external humidity sensor.

169. A heated golfer assist cover for a golf bag as described in clause 167 or any other clause, wherein said at least one humidity sensor comprises multiple section-specific humidity sensors.

170. A heated golfer assist cover for a golf bag as described in clause 161 or any other clause, wherein said golf round data comprises golfer handicap data.

171. A heated golfer assist cover for a golf bag as described in clause 161 or any other clause, wherein said golf round data comprises golfer biometrics data.

172. A heated golfer assist cover for a golf bag as described in clause 161 or any other clause, wherein said golf round data comprises golf club head data.

173. A heated golfer assist cover for a golf bag as described in clause 161 or any other clause, wherein said golf round data comprises golf club shaft data.

174. A heated golfer assist cover for a golf bag as described in clause 161 or any other clause, wherein said golf round data comprises golf club grip data.

175. A heated golfer assist cover for a golf bag as described in clause 161 or any other clause, wherein said golf round data comprises golf club type data.

176. A heated golfer assist cover for a golf bag as described in clause 161 or any other clause, wherein said golf round data comprises golf club make data.

177. A heated golfer assist cover for a golf bag as described in clause 161 or any other clause, wherein said golf round data comprises golf ball data.

178. A heated golfer assist cover for a golf bag as described in clause 161 or any other clause, wherein said golf round data comprises golf ball spin data.

179. A heated golfer assist cover for a golf bag as described in clause 161 or any other clause, wherein said golf round data comprises golf ball distance data.

180. A heated golfer assist cover for a golf bag as described in clause 161 or any other clause, wherein said golf round data comprises golf course gameplay data.

181. A heated golfer assist cover for a golf bag as described in clause 161 or any other clause, wherein said golf round data comprises golfer preference data.

182. A heated golfer assist cover for a golf bag as described in clause 161 or any other clause, wherein said golf round data comprises real-time data.

183. A heated golfer assist cover for a golf bag as described in clause 182 or any other clause, wherein said real-time data comprises real-time data selected from the group consisting of real-time GPS data, real-time cellular data, real-time RFID data, real-time Bluetooth data, and real-time WiFi data.

184. A heated golfer assist cover for a golf bag as described in clause 182 or any other clause, wherein said real-time data comprises real-time golf course conditions data.

185. A heated golfer assist cover for a golf bag as described in clause 182 or any other clause, wherein said real-time data comprises real-time ambient temperature data.

186. A heated golfer assist cover for a golf bag as described in clause 182 or any other clause, wherein said real-time data comprises real-time ambient humidity data.

187. A heated golfer assist cover for a golf bag as described in clause 182 or any other clause, wherein said real-time data comprises real-time weather data.

188. A heated golfer assist cover for a golf bag as described in clause 182 or any other clause, wherein said real-time data comprises real-time golf course position data.

189. A heated golfer assist cover for a golf bag as described in clause 161 or any other clause, wherein said data processor comprises a data processor selected from the group consisting of a CPU, an algorithm, and a series of logic functions.

190. A heated golfer assist cover for a golf bag as described in clause 161 or any other clause, wherein said golf gameplay aid comprises an automated closure system actuator of said cover responsive to said data processor of said cover and configured to open or close an automated closure system of said cover.

191. A heated golfer assist cover for a golf bag as described in clause 190 or any other clause, wherein said automated closure system actuator comprises an actuator configured to open and close said automated closure system of said cover to affect a temperature within said inner warmth area of said cover.

192. A heated golfer assist cover for a golf bag as described in clause 190 or any other clause, wherein said automated closure system actuator comprises an actuator configured to open and close said automated closure system of said cover to affect a humidity within said inner warmth area of said cover.

193. A heated golfer assist cover for a golf bag as described in clause 190 or any other clause, wherein said automated closure system actuator comprises an actuator configured to open and close said automated closure system to expose or shelter said inner warmth area of said cover to or from a weather condition.

194. A heated golfer assist cover for a golf bag as described in clause 190 or any other clause, wherein said automated closure system actuator comprises an actuator configured to open and close said automated closure system to promote a desired golf ball elasticity.

195. A heated golfer assist cover for a golf bag as described in clause 190 or any other clause, wherein said automated closure system actuator comprises an actuator configured to open and close said automated closure system to promote a desired golf club grip feel.

196. A heated golfer assist cover for a golf bag as described in clause 190 or any other clause, wherein said automated closure system actuator comprises an actuator configured to open and close said automated closure system to promote a desired golf club shaft stiffness.

197. A heated golfer assist cover for a golf bag as described in clause 190 or any other clause, wherein said automated closure system actuator comprises an actuator configured to open and close said automated closure system to promote a desired golf club face elasticity.

198. A heated golfer assist cover for a golf bag as described in clause 190 or any other clause, wherein said automated closure system actuator comprises an actuator configured to open and close said automated closure system based on said golf round data.

199. A heated golfer assist cover for a golf bag as described in clause 161 or any other clause, wherein said golf gameplay aid comprises a thermostat of said cover responsive to said data processor of said cover and to which said heat source is responsive.

200. A heated golfer assist cover for a golf bag as described in clause 199 or any other clause, wherein said thermostat of said cover comprises a thermostat configured to change a temperature within said inner warmth area of said cover.

201. A heated golfer assist cover for a golf bag as described in clause 199 or any other clause, wherein said thermostat of said cover comprises a thermostat configured to change a humidity within said inner warmth area of said cover.

202. A heated golfer assist cover for a golf bag as described in clause 199 or any other clause, wherein said thermostat of said cover comprises a thermostat configured to promote a desired golf ball elasticity.

203. A heated golfer assist cover for a golf bag as described in clause 199 or any other clause, wherein said thermostat of said cover comprises thermostat configured to promote a desired golf club grip feel.

204. A heated golfer assist cover for a golf bag as described in clause 199 or any other clause, wherein said thermostat of said cover comprises a thermostat configured to promote a desired golf club shaft stiffness.

205. A heated golfer assist cover for a golf bag as described in clause 199 or any other clause, wherein said thermostat of said cover comprises a thermostat configured to promote a desired golf club face elasticity.

206. A heated golfer assist cover for a golf bag as described in clause 199 or any other clause, wherein said thermostat of said cover comprises a thermostat configured based on said golf round data.

207. A heated golfer assist cover for a golf bag as described in clause 161 or any other clause, wherein said golf gameplay aid comprises a golfer advice output of said cover responsive to said data processor of said cover and configured to output processed golf round data.

208. A heated cover for a golf bag as described in clause 207 or any other clause, wherein said golfer advice output of said cover comprises golfer interface hardware.

209. A heated cover for a golf bag as described in clause 207 or any other clause, wherein said golfer advice output comprises an automated closure system actuator of said cover configured to open and close an automated closure system of said cover to present an advised golf club.

210. A heated cover for a golf bag as described in clause 209 or any other clause, wherein said inner warmth area of said cover comprises a sectioned inner warmth area of said cover, and or any other clause, wherein said actuator comprises an actuator configured to open and close said automated closure system for said section having said advised golf club.

211. A heated cover for a golf bag as described in clause 207 or any other clause, wherein said golfer advice output comprises at least one thermostat of said cover configured to vary a temperature of said inner warmth area based on said processed golf round data.

212. A heated cover for a golf bag as described in clause 211 or any other clause, wherein said inner warmth area of said cover comprises a sectioned inner warmth area of said cover, and or any other clause, wherein said at least one thermostat comprises at least one thermostat configured to vary a temperature among said sections of said sectioned inner warmth area.

213. A heated cover for a golf bag as described in clause 207 or any other clause, wherein said processed golf round data comprises inner warmth area temperature advice.

214. A heated cover for a golf bag as described in clause 207 or any other clause, wherein said processed golf round data comprises sectioned inner warmth area temperature advice.

215. A heated cover for a golf bag as described in clause 207 or any other clause, wherein said processed golf round data comprises ambient temperature advice.

216. A heated cover for a golf bag as described in clause 207 or any other clause, wherein said processed golf round data comprises inner warmth area humidity advice.

217. A heated cover for a golf bag as described in clause 207 or any other clause, wherein said processed golf round data comprises sectioned inner warmth area humidity advice.

218. A heated cover for a golf bag as described in clause 207 or any other clause, wherein said processed golf round data comprises ambient humidity advice.

219. A heated cover for a golf bag as described in clause 207 or any other clause, wherein said processed golf round data comprises frequently used golf club advice.

220. A heated cover for a golf bag as described in clause 207 or any other clause, wherein said processed golf round data comprises golf club selection advice.

221. A heated cover for a golf bag as described in clause 207 or any other clause, wherein said processed golf round data comprises advice selected from the group consisting of golf ball elasticity advice, golf club grip feel advice, golf club shaft stiffness advice, golf club face elasticity advice, golf ball distance advice, and golf ball spin advice.

222. A heated cover for a golf bag as described in clause 207 or any other clause, wherein said processed golf round data comprises golf round data advice.

223. A heated cover for a golf bag as described in clause 207 or any other clause, wherein said processed golf round data comprises real-time data advice.

224. A method for assisting a golfer comprising the steps of:

enclosing the top end of a golf bag with a cover;

receiving at least one golf club head within an inner warmth area of said cover as a result of said step of enclosing the top end of a golf bag with a cover;

applying heat to said inner warmth area of said cover having at least one golf club received therein;

inputting golf round data into a data input of said cover;

storing said input golf round data in a data storage of said cover;

processing said stored golf round data with a data processor of said cover;

aiding the gameplay of a golfer with said processed golf round data.

225. A method for heating the cover of a golf bag as described in clause 224 or any other clause, wherein said step of inputting golf round data comprises the step of manually inputting golf round data.

226. A method for heating the cover of a golf bag as described in clause 224 or any other clause, wherein said step of inputting golf round data comprises the step of automatically inputting golf round data.

227. A method for heating the cover of a golf bag as described in clause 225 or 226 or any other clause, wherein said step of imputing golf round data comprises the step of inputting temperature data.

228. A method for heating the cover of a golf bag as described in clause 227 or any other clause, wherein said step of inputting temperature data comprises the step of inputting internal temperature data and external temperature data.

229. A method for heating the cover of a golf bag as described in clause 227 or any other clause, wherein said step of inputting temperature data comprises the step of inputting multiple section-specific temperature data.

230.

A method for heating the cover of a golf bag as described in clause 225 or 226 or any other clause, wherein said step of inputting golf round data comprises the step of inputting humidity data.

231. A method for heating the cover of a golf bag as described in clause 230 or any other clause, wherein said step of inputting humidity data comprises the step of inputting internal humidity data and external humidity data.

232. A method for heating the cover of a golf bag as described in clause 230 or any other clause, wherein said step of inputting humidity data comprises the step of inputting multiple section-specific humidity data.

233. A method for heating the cover of a golf bag as described in clause 224 or any other clause, wherein said step of inputting golf round data comprises the step of inputting golfer handicap data.

234. A method for heating the cover of a golf bag as described in clause 224 or any other clause, wherein said step of inputting golf round data comprises the step of inputting golfer biometrics data.

235. A method for heating the cover of a golf bag as described in clause 224 or any other clause, wherein said step of inputting golf round data comprises the step of inputting golf club head data.

236. A method for heating the cover of a golf bag as described in clause 224 or any other clause, wherein said step of inputting golf round data comprises the step of inputting golf club shaft data.

237. A method for heating the cover of a golf bag as described in clause 224 or any other clause, wherein said step of inputting golf round data comprises the step of inputting golf club grip data.

238. A method for heating the cover of a golf bag as described in clause 224 or any other clause, wherein said step of inputting golf round data comprises the step of inputting golf club type data.

239. A method for heating the cover of a golf bag as described in clause 224 or any other clause, wherein said step of inputting golf round data comprises the step of inputting golf club make data.

240. A method for heating the cover of a golf bag as described in clause 224 or any other clause, wherein said step of inputting golf round data comprises the step of inputting golf ball data.

241. A method for heating the cover of a golf bag as described in clause 224 or any other clause, wherein said step of inputting golf round data comprises the step of inputting golf ball spin data.

242. A method for heating the cover of a golf bag as described in clause 224 or any other clause, wherein said step of inputting golf round data comprises the step of inputting golf ball distance data.

243. A method for heating the cover of a golf bag as described in clause 224 or any other clause, wherein said step of inputting golf round data comprises the step of inputting golf course gameplay data.

244. A method for heating the cover of a golf bag as described in clause 224 or any other clause, wherein said step of inputting golf round data comprises the step of inputting golfer preference data.

245. A method for heating the cover of a golf bag as described in clause 224 or any other clause, wherein said step of inputting golf round data comprises the step of inputting real-time data.

246. A method for heating the cover of a golf bag as described in clause 245 or any other clause, wherein said step of inputting real-time data comprises a step selected from the group consisting of inputting real-time GPS data, inputting real-time cellular data, inputting real-time RFID data, inputting real-time Bluetooth data, and inputting real-time WiFi data.

247. A method for heating the cover of a golf bag as described in clause 245 or any other clause, wherein said step of inputting real-time data comprises the step of inputting real-time golf course conditions data.

248. A method for heating the cover of a golf bag as described in clause 245 or any other clause, wherein said step of inputting real-time data comprises the step of inputting real-time ambient temperature data.

249. A method for heating the cover of a golf bag as described in clause 245 or any other clause, wherein said step of inputting real-time data comprises the step of inputting real-time ambient humidity data.

250. A method for heating the cover of a golf bag as described in clause 245 or any other clause, wherein said step of inputting real-time data comprises the step of inputting real-time weather data.

251. A method for heating the cover of a golf bag as described in clause 245 or any other clause, wherein said step of inputting real-time data comprises the step of inputting real-time golf course position data.

252. A method for heating the cover of a golf bag as described in clause 224 or any other clause, wherein said step of processing comprises a step selected from the group consisting of processing with a data processor, processing with a CPU, processing with an algorithm, and processing with a series of logic functions.

253. A method for heating the cover of a golf bag as described in clause 224 or any other clause, wherein said step of aiding the gameplay of a golfer comprises the step of actuating an automated closure system of said cover based on said processed golf round data.

254. A method for heating the cover of a golf bag as described in clause 253 or any other clause, wherein said step of actuating comprises the step of affecting a temperature within said inner warmth area of said cover.

255. A method for heating the cover of a golf bag as described in clause 253 or any other clause, wherein said step of actuating comprises the step of affecting a humidity within said inner warmth area of said cover.

256. A method for heating the cover of a golf bag as described in clause 253 or any other clause, wherein said step of actuating comprises the step of exposing or sheltering said inner warmth area of said cover to or from a weather condition.

257. A method for heating the cover of a golf bag as described in clause 253 or any other clause, wherein said step of actuating comprises the step of promoting a desired golf ball elasticity.

258. A method for heating the cover of a golf bag as described in clause 253 or any other clause, wherein said step of actuating comprises the step of promoting a desired golf club grip feel.

259. A method for heating the cover of a golf bag as described in clause 253 or any other clause, wherein said step of actuating comprises the step of promoting a desired golf club shaft stiffness.

260. A method for heating the cover of a golf bag as described in clause 253 or any other clause, wherein said step of actuating comprises the step of promoting a desired golf club face elasticity.

261. A method for heating the cover of a golf bag as described in clause 253 or any other clause, wherein said step of actuating comprises the step of actuating based on said golf round data.

262. A method for heating the cover of a golf bag as described in clause 224 or any other clause, wherein said step of aiding the gameplay of a golfer comprises the step of adjusting a temperature of at least one said inner warmth area based on said golf round data.

263. A method for heating the cover of a golf bag as described in clause 262 or any other clause, wherein said step of adjusting a temperature comprises the step of adjusting a temperature of said inner warmth area of said cover with at least one thermostat.

264. A method for heating the cover of a golf bag as described in clause 262 or any other clause, wherein said step of adjusting a temperature comprises the step of adjusting a humidity of said inner warmth area of said cover with at least one thermostat.

265. A method for heating the cover of a golf bag as described in clause 262 or any other clause, wherein said step of adjusting a temperature comprises the step of promoting a desired golf ball elasticity.

266. A method for heating the cover of a golf bag as described in clause 262 or any other clause, wherein said step of adjusting a temperature comprises the step of promoting a desired golf club grip feel.

267. A method for heating the cover of a golf bag as described in clause 262 or any other clause, wherein said step of adjusting a temperature comprises the step of promoting a desired golf club shaft stiffness.

268. A method for heating the cover of a golf bag as described in clause 262 or any other clause, wherein said step of adjusting a temperature comprises the step of promoting a desired golf club face elasticity.

269. A method for heating the cover of a golf bag as described in clause 262 or any other clause, wherein said step of adjusting a temperature comprises the step of adjusting a temperature based on said golf round data.

270. A method for heating the cover of a golf bag as described in clause 224 or any other clause, wherein said step of aiding the gameplay of a golfer comprises the step of providing advice to a golfer based on said processed golf round data.

271. A method for heating the cover of a golf bag as described in clause 270 or any other clause, wherein said step of providing advice comprises the step of providing advice via golfer interface hardware.

272. A method for heating the cover of a golf bag as described in clause 270 or any other clause, wherein said step of providing advice comprises the step of actuating an automated closure system of said cover to present an advised golf club.

273. A method for heating the cover of a golf bag as described in clause 272 or any other clause, wherein said step of providing advice comprises the step of actuating an automated closure system of said cover to present an advised golf club within a section of a sectioned inner warmth area of said cover.

274. A method for heating the cover of a golf bag as described in clause 270 or any other clause, wherein said step of providing advice comprises the step of varying a temperature of at least one said inner warmth area based on said processed golf round data.

275. A method for heating the cover of a golf bag as described in clause 274 or any other clause, wherein said step of varying a temperature comprises the step of varying a temperature among sections of a sectioned inner warmth area of said cover.

276. A method for heating the cover of a golf bag as described in clause 270 or any other clause, wherein said step of providing advice comprises the step of providing inner warmth area temperature advice.

277. A method for heating the cover of a golf bag as described in clause 270 or any other clause, wherein said step of providing advice comprises the step of providing sectioned inner warmth area temperature advice.

278. A method for heating the cover of a golf bag as described in clause 270 or any other clause, wherein said step of providing advice comprises the step of providing ambient temperature advice.

279. A method for heating the cover of a golf bag as described in clause 270 or any other clause, wherein said step of providing advice comprises the step of providing inner warmth area humidity advice.

280. A method for heating the cover of a golf bag as described in clause 270 or any other clause, wherein said step of providing advice comprises the step of providing sectioned inner warmth area humidity advice.

281. A method for heating the cover of a golf bag as described in clause 270 or any other clause, wherein said step of providing advice comprises the step of providing ambient humidity advice.

282. A method for heating the cover of a golf bag as described in clause 270 or any other clause, wherein said step of providing advice comprises the step of providing frequently used golf club advice.

283. A method for heating the cover of a golf bag as described in clause 270 or any other clause, wherein said step of providing advice comprises the step of providing golf club selection advice.

284. A method for heating the cover of a golf bag as described in clause 270 or any other clause, wherein said step of providing advice comprises the step of providing inner warmth area temperature advice.

285. A method for heating the cover of a golf bag as described in clause 270 or any other clause, wherein said step of providing advice comprises a step selected from the group consisting of providing golf ball elasticity advice, providing golf club grip feel advice, providing golf club shaft stiffness advice, providing golf club face elasticity advice, providing golf ball distance advice, and providing golf ball spin advice.

286. A method for heating the cover of a golf bag as described in clause 270 or any other clause, wherein said step of providing advice comprises the step of providing real-time data advice.

287. A system substantially as herein described with reference to any one or more of the Figures and Description.

288. The process according to clauses 81 or 224 and further comprising any of the steps as shown in FIGS. 1-9, separately, or in any combination or permutation.

As can be easily understood from the foregoing, the basic concepts of the various embodiments of the present invention(s) may be embodied in a variety of ways. It involves both golf club and golf ball heating techniques as well as devices to accomplish the appropriate optimal golf club and golf ball temperature for the playing conditions. In this application, both golf club and golf ball heating techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this patent application is intended to serve as a basic description. The reader should be aware that the specific discussion may not explicitly describe all embodiments possible; many alternatives are implicit. It also may not fully explain the generic nature of the various embodiments of the invention(s) and may not explicitly show how each feature or element can actually be representative of a broader function or of a great variety of alternative or equivalent elements. As one example, terms of degree, terms of approximation, and/or relative terms may be used. These may include terms such as the words: substantially, about, only, and the like. These words and types of words are to be understood in a dictionary sense as terms that encompass an ample or considerable amount, quantity, size, etc. as well as terms that encompass largely but not wholly that which is specified. Further, for this application if or when used, terms of degree, terms of approximation, and/or relative terms should be understood as also encompassing more precise and even quantitative values that include various levels of precision and the possibility of claims that address a number of quantitative options and alternatives. For example, to the extent ultimately used, the existence or non-existence of a substance or condition in a particular input, output, or at a particular stage can be specified as substantially only x or substantially free of x, as a value of about x, or such other similar language. Using percentage values as one example, these types of terms should be understood as encompassing the options of percentage values that include 99.5%, 99%, 97%, 95%, 92% or even 90% of the specified value or relative condition; correspondingly for values at the other end of the spectrum (e.g., substantially free of x, these should be understood as encompassing the options of percentage values that include not more than 0.5%, 1%, 3%, 5%, 8% or even 10% of the specified value or relative condition, all whether by volume or by weight as either may be specified). In context, these should be understood by a person of ordinary skill as being disclosed and included whether in an absolute value sense or in valuing one set of or substance as compared to the value of a second set of or substance. Again, these are implicitly included in this disclosure and should (and, it is believed, would) be understood to a person of ordinary skill in this field. Where the application is described in device-oriented terminology, each element of the device implicitly performs a function. Apparatus claims may not only be included for the device described, but also method or process claims may be included to address the functions of the embodiments and that each element performs. Neither the description nor the terminology is intended to limit the scope of the claims that will be included in any subsequent patent application.

It should also be understood that a variety of changes may be made without departing from the essence of the various embodiments of the invention(s). Such changes are also implicitly included in the description. They still fall within the scope of the various embodiments of the invention(s). A broad disclosure encompassing the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of embodiments of the invention(s) both independently and as an overall system.

Further, each of the various elements of the embodiments of the invention(s) and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the various embodiments of the invention(s), the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which embodiments of the invention(s) is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "heating element" should be understood to encompass disclosure of the act of "heating" or "act of heating a golf ball or golf club"—whether explicitly discussed or not—and, conversely, were there effectively disclosure of the act of "heating." such a disclosure should be understood to encompass disclosure of a "heating element" and even a "means for heating." Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function. As other non-limiting examples, it should be understood that claim elements can also be expressed as any of: components, programming, subroutines, logic, or elements that are configured to, or configured and arranged to, provide or even achieve a particular result, use, purpose, situation, function, or operation, or as components that are capable of achieving a particular activity, result, use, purpose, situation, function, or operation. All should be understood as within the scope of this disclosure and written description.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference or other information statement filed with the application are hereby appended and hereby incorporated by reference, however, as to each of the above, to the extent that such information or statements incorporated by reference might be considered inconsistent with the patenting of the various embodiments of invention(s) such statements are expressly not to be considered as made by the applicant(s).

REFERENCES TO BE INCORPORATED BY REFERENCE

US Patents

| Patent No. | Kind Code | Date Issued | Patentee |
|---|---|---|---|
| 5,062,528 | | 1991 Nov. 5 | Whitaker, Jr. |
| 5,797,439 | | 1998 Aug. 25 | Brandriet |
| 3,059,681 | | 1961 Feb. 16 | Lorbeski |
| 11,019,686 | B2 | 2021 May 25 | Herbstman et al. |
| 9,950,229 | B2 | 2018 Apr. 24 | Lee et al. |
| 8,809,751 | B2 | 2014 Aug. 19 | Ellis et al. |
| 8,523,645 | B2 | 2013 Sep. 3 | Lee |
| 8,294,066 | B2 | 2012 Jan. 23 | Gill et al. |
| 8,242,418 | B2 | 2012 Aug. 14 | Kuo |
| 8,110,781 | B2 | 2012 Feb. 7 | Kuo |
| 7,628,187 | B2 | 2009 Dec. 8 | Mittelstaedt |
| 7,238,920 | B1 | 2007 Jul. 3 | Prieto et al. |
| 7,138,613 | B1 | 2006 Nov. 21 | Walsh et al. |
| 7,004,317 | B2 | 2006 Feb. 28 | Severa et al. |
| 6,870,135 | B2 | 2005 Mar. 22 | Hamm et al. |
| 6,723,967 | B2 | 2004 Apr. 20 | Rock et al. |
| 6,582,456 | B1 | 2003 Jun. 24 | Hand et al. |
| 6,247,469 | | 2001 Jun. 19 | Guard |
| 6,229,132 | B1 | 2001 May 8 | Knetter |
| 6,222,159 | B1 | 2001 Apr. 24 | Healy |
| 5,921,387 | | 1999 Jul. 13 | Arzoomanian et al. |
| 5,915,551 | | 1999 Jun. 29 | Vavro |
| 5,860,519 | | 1999 Jun. 19 | Meyer et al. |
| 5,860,415 | | 1999 Jan. 19 | Waters |
| 5,834,738 | | 1998 Nov. 10 | Wilson |
| 5,465,840 | | 1995 Nov. 14 | Joh |
| 5,341,927 | | 1994 Aug. 30 | Coyner |
| 5,105,067 | | 1992 Apr. 14 | Brekkestram et al. |
| 5,062,528 | | 1991 Nov. 5 | Whitaker, Jr. |
| 4,545,362 | | 1985 Oct. 8 | Hendricks |
| 4,420,681 | | 1983 Dec. 13 | Arnold |
| 4,155,002 | | 1979 May 15 | Cohen |
| 4,065,660 | | 1977 Dec. 27 | Berard |
| 4,049,949 | | 1977 Sep. 20 | Fitzsimons |
| 3,707,279 | | 1972 Dec. 26 | Kaiser |
| 3,683,155 | | 1972 Aug. 8 | Loofbourow |

US Publications

| Publication No. | Kind Code | Date Published | Patentee |
|---|---|---|---|
| 20190037648 | A1 | 2019 Jan. 31 | Herbstman et al. |
| 20090008008 | A1 | 2009 Jan. 8 | Kuo |
| 20170087436 | A1 | 2017 Mar. 30 | Peterson |
| 20160144253 | A1 | 2016 May 26 | Lee et al. |
| 20100248852 | A1 | 2010 Sep. 30 | Lee |
| 20100222152 | A1 | 2010 Sep. 2 | Jaekel et al. |
| 20140353300 | A1 | 2014 Dec. 4 | Swiatek et al. |
| 20090321290 | A1 | 2009 Dec. 31 | Kuo |
| 20090008008 | A1 | 2009 Jan. 8 | Kuo |
| 20080272104 | A1 | 2008 Nov. 6 | Farrington |
| 20080047857 | A1 | 2008 Feb. 28 | Blumenkrantz et al. |
| 20070251844 | A1 | 2007 Nov. 1 | Reid |
| 20070094884 | A1 | 2007 May 3 | Micheludis |
| 20060278311 | A1 | 2006 Dec. 14 | Mittelstaedt |
| 20060011111 | A1 | 2006 Jan. 19 | Stoddard et al. |

Foreign Patents

| Patent No. | Kind Code | Country Code | Date Issued | Patentee |
|---|---|---|---|---|
| 2924299 | | FR | 2009 May 29 | Vela Antoine |

Non Patent Literature

Really, Is a Heated Club Head Cover Necessary? www.golf-patents.com/really-is-a-heated-club-head-cover-necessary/obtained Nov. 2, 2020. 5 pages.
THE GRATEFUL GOLFER, Golf Balls and Cold Temperatures. Jan. 17, 2016, Dec. 20, 2016. https://thegratefulgolfer.com/2016/01/17/golf-balls-and-cold-temperatures/. 6 pages.
EBAY, Golf Ball Warmer Vintage by Hot Shot Warms 3 Balls With Cloth Bag/Instructions. obtained Nov. 2, 2020. 1 page.
Amazon.com, Longridge Storm Hood Golf Bag Cover Black. Obtained Oct. 1, 2021. 8 pages.
Amazon.com, Amy Sport Golf Bag Rain Cover Waterproof Hood Protection Black [ . . . ]. Obtained Oct. 1, 2021. 7 pages.
U.S. Provisional Patent Application No. 63/137,439, filed Jan. 14, 2021. First Named Inventor: Eshleman.

In addition and as to computer aspects and each aspect amenable to programming or other electronic automation, it should be understood that in characterizing these and all other aspects of the various embodiments of the invention(s)—whether characterized as a device, a capability, an element, or otherwise, because all of these can be implemented via software, hardware, or even firmware structures as set up for a general purpose computer, a programmed chip or chipset, an ASIC, application specific controller, subroutine, logic, or other known programmable or circuit specific structure—it should be understood that all such aspects are at least defined by structures including, as person of ordinary skill in the art would well recognize: hardware circuitry, firmware, programmed application specific components, and even a general purpose computer programmed to accomplish the identified aspect. For such items implemented by programmable features, the applicant (s) should be understood to have support to claim and make a statement of invention to at least: xv) processes performed with the aid of or on a computer, machine, or computing machine as described throughout the above discussion, xvi) a programmable apparatus as described throughout the above discussion, xvii) a computer readable memory encoded with data to direct a computer comprising means or elements which function as described throughout the above discussion, xviii) a computer, machine, or computing machine configured as herein disclosed and described, xix) individual or combined Thus, the applicant(s) should be understood to have support to claim and make claims to embodiments including at least: i) each of the heating systems as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such processes, methods, systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

subroutines, processor logic, and/or programs as herein disclosed and described, xx) a carrier medium carrying computer readable code for control of a computer to carry out separately each and every individual and combined method described herein or in any claim, xxi) a computer program to perform separately each and every individual and combined method disclosed, xxii) a computer program containing all and each combination of means for performing each and every individual and combined step disclosed, xxiii) a storage medium storing each computer program disclosed, xxiv) a signal carrying a computer program disclosed, xxv) a processor executing instructions that act to achieve the steps and activities detailed, xxvi) circuitry configurations (including configurations of transistors, gates, and the like) that act to sequence and/or cause actions as detailed, xxvii) computer readable medium(s) storing instructions to execute the steps and cause activities detailed, xxviii) the related methods disclosed and described, xxix) similar, equivalent, and even implicit variations of each of these systems and methods, xxx) those alternative designs which accomplish each of the functions shown as are disclosed and described, xxxi) those alternative designs and methods which accomplish each of the functions shown as are implicit to accomplish that which is disclosed and described, xxxii) each feature, component, and step shown as separate and independent inventions, and xxxiii) the various combinations of each of the above and of any aspect, all without limiting other aspects in addition.

In addition, the applicant(s) should be understood to have support to claim and make a statement of the invention that may include claims directed to:

- providing desired golf club heating
- providing desired golf ball or other equipment heating
- systems to achieve desired golf club heating
- providing desired golf ball or other equipment heating
- systems to achieve desired golf ball or other equipment heating
- a golf club heating device
- a golf ball or other equipment heating device
- a golf club storage device
- a golf ball or other equipment storage device
- specific configurations of golf club heating devices
- specific configurations of golf ball or other equipment heating devices
- components or structures for a desired golf club heating device
- components or structures for a desired golf ball or other equipment heating device
- systems that enable a manufacturer or other user to customize golf club heating
- systems that enable a manufacturer or other user to customize golf ball or other equipment heating
- systems that enable a manufacturer or other user to customize golf club heating devices
- systems that enable a manufacturer or other user to customize golf ball or other equipment heating devices
- specific configurations of efficient golf club heating devices
- specific configurations of efficient golf ball or other equipment heating devices
- specific configurations of optimized golf club heating devices
- specific configurations of optimized golf ball or other equipment heating devices
- systems that enable efficient heating of a golf club
- systems that enable optimized heating of a golf club
- systems that enable efficient heating of a golf ball or other equipment
- systems that enable optimized heating of a golf ball or other equipment
- components or structures for the desired golf club heating devices
- components or structures for the desired golf ball or other equipment heating devices
- systems to metrically control efficient golf club heating
- systems to metrically control efficient golf ball or other equipment heating
- systems to utilize complex ratios in efficient golf club heating
- systems to utilize complex ratios in efficient golf ball or other equipment heating
- components or structures to utilize complex ratios in efficient golf club heating
- components or structures to utilize complex ratios in efficient golf ball or other equipment heating With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrases "comprising", "including", "containing", "characterized by" and "having" are used to maintain the "open-end" claims herein, according to traditional claim interpretation including that discussed in MPEP § 2111.03. Thus, unless the context requires otherwise, it should be understood that the terms "comprise" or variations such as "comprises" or "comprising", "include" or variations such as "includes" or "including", "contain" or variations such as "contains" and "containing". "characterized by" or variations such as "characterizing by", "have" or variations such as "has" or "having", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 9 or any other claim" or the like, it could be re-drafted as dependent on claim 1, claim 8, or even claim 11 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the various embodiments of the application, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A heated cover for a golf bag comprising:

a cover configured to enclose a top end of a golf bag;

a heat seal of said cover configured to conform to said top end of said golf bag;

an inner warmth area of said cover configured to receive therewithin at least one golf club head;

a main heat source of said cover configured to apply heat to said inner warmth area of said cover;

at least two golf ball pouches of said cover disposed inside said cover;

an inner warmth area of each said golf ball pouch configured to receive therewithin a least one golf ball;

an auxiliary heat source of each said golf ball pouch configured to apply heat to said inner warmth area of said golf ball pouch;

a data input of said cover configured for input of golf round data;

a data storage of said cover responsive to said data input of said cover and configured to store said golf round data;

a data processor of said cover responsive to said data storage of said cover and to which at least one said heat source is responsive;

a golfer advice output of said cover responsive to said data processor of said cover and configured to output processed golf round data;

at least one power source of said cover to which each said heat source, said data input, said data storage, said data processor, each said thermostat, and said golfer advice output are responsive.

2. A heated cover for a golf bag as described in claim 1 wherein said cover comprises a cover selected from the group consisting of an insulated cover, a waterproof cover, a one removeable piece cover, a lightweight cover, a portable cover, a reusable cover, a breathable cover, and a quick change cover.

3. A heated cover for a golf bag as described in claim 1 further comprising a circulation component configured to circulate heat from said inner warmth area of said cover to the body of said golf bag.

4. A heated cover for a golf bag as described in claim 1 wherein said heat seal comprises an adjustable heat seal.

5. A heated cover for a golf bag as described in claim 4 wherein said adjustable heat seal comprises a heat seal selected from the group consisting of a hook and loop heat seal, a strap heat seal, a webbing heat seal, a drawstring heat seal, an elastic heat seal, a magnetic heat seal, and a snap heat seal.

6. A heated cover for a golf bag as described in claim 4 wherein said adjustable heat seal comprises an easy secure clip.

7. A heated cover for a golf bag as described in claim 6 wherein said easy secure clip comprises an easy secure clip selected from the group consisting of an interlocking clip, a hook clip, and a magnetic clip.

8. A heated cover for a golf bag as described in claim 4 wherein said adjustable heat seal comprises a heat seal selected from the group consisting of a heat seal configured to conform to said golf bag, a heat seal separate from an adjustable closure of said golf bag, a natural heat seal, and a polymer heat seal.

9. A heated cover for a golf bag as described in claim 1 further comprising an automated closure system actuator of said cover responsive to said data processor of said cover and configured to open or close an automated closure system of said cover.

10. A heated cover for a golf bag as described in claim 9 wherein said automated closure system comprises an automated closure system selected from the group consisting of a motorized automated closure system, a spring loaded automated closure system, a mechanical automated closure system, a counterweighted automated closure system, a magnetic automated closure system, an electrical automated closure system, and a computer controlled automated closure system.

11. A heated cover for a golf bag as described in claim 9 wherein said automated closure system actuator comprises an actuator configured to open and close said automated closure system of said cover to affect a temperature within said inner warmth area of said cover.

12. A heated cover for a golf bag as described in claim 1 wherein said at least two golf ball pouches comprise cold contamination prevention golf ball pouches.

13. A heated cover for a golf bag as described in claim 1 wherein said at least two golf ball pouches comprise accelerated warming golf ball pouches.

14. A heated cover for a golf bag as described in claim 1 wherein said inner warmth area of each said golf ball pouch comprises an additional heat source for said inner warmth area of said cover.

15. A heated cover for a golf bag as described in claim 1 wherein said at least two golf ball pouches comprise temperature varied golf ball pouches.

16. A heated cover for a golf bag as described in claim 1 wherein said data input comprises a manual data input.

17. A heated cover for a golf bag as described in claim 1 wherein said data input comprises an automated data input.

18. A heated cover for a golf bag as described in claim 17 wherein said data input comprises a data input responsive to at least one temperature sensor.

19. A heated cover for a golf bag as described in claim 18 wherein said at least one temperature sensor comprises at least one internal temperature sensor and at least one external temperature sensor.

20. A heated cover for a golf bag as described in claim 18 wherein said at least one temperature sensor comprises multiple section-specific temperature sensors.

21. A heated cover for a golf bag as described in claim 17 wherein said data input comprises a data input responsive to at least one humidity sensor.

22. A heated cover for a golf bag as described in claim 21 wherein said at least one humidity sensor comprises at least one internal humidity sensor and at least one external humidity sensor.

23. A heated cover for a golf bag as described in claim 21 wherein said at least one humidity sensor comprises multiple section-specific humidity sensors.

24. A heated cover for a golf bag as described in claim 9 wherein said automated closure system actuator comprises an actuator configured to open and close said automated closure system of said cover to affect a humidity within said inner warmth area of said cover.

25. A heated cover for a golf bag as described in claim 9 wherein said automated closure system actuator comprises an actuator configured to open and close said automated closure system to expose or shelter said inner warmth area of said cover to or from a weather condition.

26. A heated cover for a golf bag as described in claim 1 wherein said at least one thermostat of said cover comprises a thermostat configured to change a humidity within said inner warmth area of said cover.

27. A heated cover for a golf bag as described in claim 1 wherein said at least one thermostat of said cover comprises a thermostat configured to change a humidity within said inner warmth area of said cover.

28. A heated cover for a golf bag as described in claim 1 wherein said golfer advice output of said cover comprises golfer interface hardware.

29. A heated cover for a golf bag as described in claim 9 wherein said golfer advice output interfaces with said automated closure system actuator of said cover configured to open and close said automated closure system of said cover to present an advised golf club.

30. A heated cover for a golf bag as described in claim 29 wherein said inner warmth area of said cover comprises a sectioned inner warmth area of said cover, and wherein said automated closure system actuator comprises an actuator configured to open and close said automated closure system for said section having said advised golf club.

31. A heated cover for a golf bag as described in claim 1 wherein said golfer advice output comprises said at least one thermostat of said cover configured to vary a temperature of said inner warmth area based on said processed golf round data.

32. A heated cover for a golf bag as described in claim 31, wherein said inner warmth area of said cover comprises a sectioned inner warmth area of said cover, and wherein said at least one thermostat comprises at least one thermostat configured to vary a temperature among said sections of said sectioned inner warmth area.

* * * * *